US007959259B2

(12) United States Patent
Yamaguchi et al.

(10) Patent No.: US 7,959,259 B2
(45) Date of Patent: Jun. 14, 2011

(54) INKJET PRINTING APPARATUS AND DRIVING CONTROL METHOD

(75) Inventors: Hiromitsu Yamaguchi, Yokohama (JP); Tsuyoshi Shibata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 796 days.

(21) Appl. No.: 11/953,429

(22) Filed: Dec. 10, 2007

(65) Prior Publication Data

US 2008/0136854 A1 Jun. 12, 2008

(30) Foreign Application Priority Data

Dec. 11, 2006 (JP) ..... 2006-333864

(51) Int. Cl.
*B41J 29/38* (2006.01)

(52) U.S. Cl. ..... 347/41; 347/12

(58) Field of Classification Search ..... 347/15, 347/43, 9–12, 40–41
See application file for complete search history.

(56) References Cited

U.S. PATENT DOCUMENTS

| | | | | |
|---|---|---|---|---|
| 6,896,357 | B2 * | 5/2005 | Murakami et al. | 347/43 |
| 6,960,036 | B1 | 11/2005 | Fujita et al. | |
| 7,108,352 | B2 * | 9/2006 | Muraoka | 347/40 |
| 7,168,775 | B2 * | 1/2007 | Kuruma et al. | 347/14 |
| 7,198,345 | B2 | 4/2007 | Shibata et al. | 347/15 |
| 2006/0119632 | A1 | 6/2006 | Ochiai et al. | 347/15 |
| 2006/0119660 | A1 | 6/2006 | Ochiai et al. | 347/40 |

FOREIGN PATENT DOCUMENTS

| | | |
|---|---|---|
| JP | 2000-071433 | 3/2000 |
| JP | 2001-129985 | 5/2001 |

* cited by examiner

*Primary Examiner* — Lamson D Nguyen
(74) *Attorney, Agent, or Firm* — Fitzpatrick, Cella, Harper & Scinto

(57) ABSTRACT

In a configuration in which a printhead including a plurality of first printing elements for discharging ink droplets and a plurality of second printing elements for discharging ink droplets larger than ink droplets discharged by the first printing elements is used, the first and second plurality of printing elements are divided into multiple blocks in such a manner that the first printing elements belong to one block and the second printing elements belong to another block. The blocks are individually driven in a time-divisional manner. In the time-divisional driving, the block consisting of the plurality of first printing elements is driven first and then the block consisting of the second printing elements is driven.

8 Claims, 25 Drawing Sheets

INKJET PRINTING APPARATUS AND DRIVING CONTROL METHOD

BACKGROUND OF THE INVENTION

1. Field of the Invention

The present invention relates to an inkjet printing apparatus and a driving control method which enable registration adjustment for preventing a relative misregistration between droplet landing points of printing elements of a printhead.

2. Description of the Related Art

There are various printing apparatuses, including printing means provided in printers, copying machines, and facsimile machines, for printing images and other objects and printout devices used with multifunctional electronic apparatuses such as computers and word processors or workstations. These printing apparatuses are designed to print images and other objects on printing media such as paper and plastic film in accordance with image information.

Such printing apparatuses can be classified by printing method as inkjet, wire dot-matrix, thermal, laser-beam and other printing apparatuses.

Among these printing apparatuses, inkjet printing apparatuses discharge ink drops through a printhead onto a printing medium to print. Compared with other types of printing apparatuses, the inkjet printing apparatuses have a number of advantages. For example, inkjet printing apparatuses can be easily designed to print in high-definition and are faster and quieter, and lower in cost.

Further, color outputs such as color pictures have grown in importance in recent years and many color inkjet printing apparatuses that print high-quality images comparable to silver-based photographic prints have been developed.

Such an inkjet printing apparatus typically uses a printhead on which multiple printing elements are arranged and multiple ink nozzles and ink channels are integrated in order to increase printing speed, and has multiple such printing heads in order to support color printing.

While various printing technologies for printers are known, attention is being given to inkjet printing technology today for reasons such as the capability to print on printing media such as paper in a non-contact manner, ease of color printing, and quietness.

Serial printing technology is commonly used in inkjet printers because of low cost and ease of downsizing, among other reasons. In the serial printing technology, a printhead that discharges ink in accordance with desired print information is attached and is driven to scan forward and backward in the direction perpendicular to the direction in which printing media are fed.

These inkjet printers have been significantly sophisticated recently and high printing speeds comparable to laser-beam printers have been achieved. Furthermore, demand for faster color image printing is growing with increase in processing speed of personal computers and proliferation of the Internet.

To achieve high-image-quality printing, registration adjustment is required which prevents relative misregistrations between landing points of ink droplets from nozzles of a printhead.

There are many techniques for registration adjustment, including a method of preventing misregistration between droplet landing points of color nozzles and a method of preventing misregistration between landing points of droplets of the same color ink in first (forward) and second (backward) scan directions in bidirectional printing. Such methods are implemented in many products as known techniques.

FIG. 1 shows an exemplary arrangement of nozzles of a printhead 101. The printhead shown in FIG. 1 has multiple pairs of nozzle arrays to enable discharge of different inks. A nozzle array 102 consisting of even-numbered nozzles 104, each having an even number assigned to it for convenience, is located to the left of an ink supply path 106. A nozzle array 103 consisting of odd-numbered nozzles 104, each having an odd number assigned to it for convenience, is located to the right of the ink supply path 106. Ink is supplied to the nozzles 104 individually through each individual ink channel 105.

The positional relation between the nozzles 104 is as follows. Two arrays of many nozzles arranged at a pitch py in the y-direction are provided. The two arrays are offset from each other in the x-direction by a distance px equivalent to a predetermined number of pixels. The even-numbered nozzle array 102 and the odd-numbered nozzle array 103 are shifted from each other in the y-direction by a distance of (py/2).

With this arrangement, printing can be performed with a resolution twice as high as the density (resolution) of nozzles per array by adjusting discharge timing between both nozzle arrays. However, registration of landing points between rasters of ink of the same color and registration of landing points between ink discharged from the even-numbered nozzle array 102 and ink discharged from the odd-numbered nozzle array 103 must be adjusted.

A method for adjusting registration is proposed in Japanese Patent Laid-Open No. 2001-129985, for example.

A printhead driving method is commonly used in which multiple nozzles arranged in one line in the column direction (in the y-direction) are divided into groups of nozzles and the printing elements of the nozzle groups are individually driven at different timings (time-divisional driving). The method is described in detail in Japanese Patent Laid-Open No. 2000-071433. By time-divisional driving of printing elements, the ink supply rate and stability can be improved and consumption of power required for discharging can be reduced. Also disclosed is a configuration in which nozzles disposed at regular intervals are grouped into the same block and an order in which blocks are driven is chosen so that adjacent nozzles are not successively driven, thereby reducing the impact of driving of an adjacent nozzle.

Registration can be adjusted by shifting a column of print data by a distance ranging from a half pixel to a number of pixels or by shifting print timing by a predetermined amount of time or by other methods.

The method of shifting a column of print data by a distance ranging from a half pixel to a number of pixels is used in order to roughly adjust registration between landing points of droplets of ink of different colors discharged from nozzles or registration between landing points of droplets of ink of the same color discharged in first and second scan directions in bidirectional printing.

As shown in FIG. 2, if printing is performed with a print resolution of 1200 dpi in the scanning direction of the printhead, a column of print data of 1200 dpi can be shifted by shifting the print data by one or more pixels. Also, by shifting a column of print data by a half pixel, the print data can be shifted by a pixel pitch equivalent to ½ of print resolution. In the example in FIG. 2, 2400 dpi data can be shifted as a unit.

In the method of shifting print timing by a predetermined amount of time, timing of printing is shifted within an amount of time allocated to a column for printing with a predetermined print resolution (column timing). With this method, print timing can be shifted on a cycle-by-cycle basis of a base clock that operates the printing apparatus. This method is used for correcting a small misalignment caused by a difference between individual heads that arose in manufacturing or a difference in printing environment.

However, these methods cannot adjust registration between landing points of nozzles in the same array because they shift landing points by moving nozzle arrays to shift the print starting position.

Misregistration between landing points of ink droplets from the same nozzle array has not posed a significant problem in conventional printheads because the size of a droplet of ink is relatively large, in the range between 5 and 30 pl (picoliters). Accordingly, it is sufficient if registration between landing points can be adjusted at the level of nozzle array. Recently, however, the sizes of ink droplets have been minimized in order to achieve high-quality printing comparable to silver-based photographic prints. Ink droplets as small as 1 to 2 pl can be discharged.

When the size of a droplet is reduced to ½, the number of dots to be placed for printing in the same print area doubles in both vertical and horizontal directions as shown in FIG. 3, that is, four times as many as the number of dots will be required in total. Accordingly, the printing speed will significantly decrease, of course, if the number of nozzles of a printhead, the density of nozzles in an array, and the discharge frequency are the same.

To achieve a faster printing speed than before by using a printhead that discharges such small droplets, a method for increasing the number of nozzles and the density of nozzles arranged in a printhead to increase the coverage area that can be printed at a time or a method for increasing the frequency of discharge of ink droplets must be developed.

During development aimed at reducing droplet size and increasing printing speed, a new kind of problem has arisen associated with such smaller droplet sizes. In particular, the direction in which ink droplets are discharged from a printhead on a carriage that moves quickly in an existing printer system is significantly changed by its air resistance.

The change of the discharge direction changes the landing points of ink droplets both in the scanning direction of the printhead and in the direction in which nozzles are arranged, which of course results in degradation of image quality. Moreover, it has been shown that if the time-divisional driving stated above is performed, misregistration occurs between the landing points of ink droplets discharged from nozzles in the first driven block and the landing points of ink droplets discharged from nozzles in the last driven block. Therefore, particularly misregistration of landing points in the same nozzle array in the scanning direction of the printhead increases because misregistration of landing points caused by the time-divisional driving is combined with misregistration of landing points caused by the air resistance.

As an example of development aimed at reduction of droplet size and increase of printing speed mentioned above, changes to the configuration of printheads are being actively made. Specifically, there are a printhead configuration in which the density of nozzles of a nozzle array that discharges small ink droplets of the same color is increased to increase the coverage area, a printhead configuration in which an array of nozzles that discharge small ink droplets of the same color and an array of large-diameter nozzles that discharge large ink droplets are provided, and a combination of both.

Among these printhead configurations, there are a printhead in which nozzles in a nozzle array that discharge ink droplets of the same size have different physical shapes and a printhead in which nozzles that discharge ink droplets of different sizes are provided in the same nozzle array. In most of these printheads, as in conventional printheads, the same driving signal is provided for the nozzles of the same array. Misregistration of landing points in a printhead in which nozzles that discharge ink droplets of different sizes are provided in the same array tends to be larger. Therefore, it is becoming difficult to fine-adjust landing points simply by a conventional method of adjusting registration of landing points on a nozzle-array basis.

To solve these problems, there is a technique for adjusting registration of landing points by providing means for inputting multiple driving signals into printing elements in the same nozzle array.

However, the number of nozzles and varieties of ejectable droplet sizes required of printheads are increasing year after year whereas competition to keep prices of inkjet printers down is intensifying. While it is possible to introduce the technique described above to relatively expensive printers, introduction of the technique to low-cost printers is difficult because the technique requires an increased number of driving signal lines to printheads and as many drive timing circuits as the number of printheads, which increase the complexity and costs of the system. Accordingly, most printers integrate signals other than a signal that transmits print data into a common signal (signal line) or integrate signals for discharging ink droplets of the same size into a common signal line.

It is imaginable that, as the number of nozzles of a printhead and the number of varieties of dot sizes increase, demand to integrate signals for driving printheads into a common signal in expensive printers will grow as well. There has been proposed no method for adjusting landing points of nozzles in the same array having different discharge characteristics that is adequate in terms of both cost and performance.

SUMMARY OF THE INVENTION

The present invention has been made in light of the problems described above. In particular, a feature of the present invention is to provide an inkjet printing apparatus and a method for adjusting registration of landing points of droplets capable of adjusting registration between print dots with a high precision without provision of means for inputting multiple driving signals to printing elements in the same nozzle array.

According to an aspect of the present invention, there is provided an inkjet printing apparatus which performs printing by discharging ink droplets having different sizes to a printing medium by using a printhead having a plurality of first printing elements which generate energy for discharging ink droplets and a plurality of second printing elements which are provided for discharging ink droplets larger than those from the plurality of first printing elements and generate energy for discharging ink droplets, wherein the inkjet printing apparatus comprises:

a time-divisional driving unit which divides the plurality of first printing elements and the plurality of second printing elements into multiple blocks so that the plurality of first printing elements belong to a block different from a block to which the plurality of second printing elements belong and drives the blocks individually in a time-divisional manner; and a control unit which controls the time-divisional driving unit to drive the block consisting of the plurality of first printing elements first and then drive the block consisting of the plurality of second printing elements.

According to another aspect of the present invention, there is provided a driving control method in an inkjet printing apparatus which performs printing by discharging ink droplets having different sizes to a printing medium by using a printhead having a plurality of first printing elements which generate energy for discharging ink droplets and a plurality of second printing element which are provided for discharging ink droplets larger than those from the plurality of first printing elements and generate energy for discharging ink droplets, wherein the plurality of first printing elements and the plurality of second printing elements are divided into multiple blocks so that the plurality of first printing elements belong to a block different from a block to which the plurality of second printing elements belong; and the divided blocks are individually driven in a time-divisional manner and driving of the printhead is controlled so that the plurality of first printing elements are driven first and then the plurality of second printing elements are driven.

Further features of the present invention will become apparent from the following description of exemplary embodiments with reference to the attached drawings.

DESCRIPTION OF THE EMBODIMENTS

Preferable embodiments of the present invention will be described in detail below with reference to the accompanying drawings. The embodiments will be described with respect to a printer which is an example of a printing apparatus using inkjet printing.

The terms "printing" and "print" as used herein refer to formation of meaningful information such as characters or graphics as well as formation of images, artwork, or patterns on a printing medium or modification of a printing medium, regardless of whether they are meaningful or not, and regardless of whether they are made visible to the human eye.

The term "printing medium" as used herein refers to paper used in typical printing apparatuses as well as any material, such as cloth, plastic film, metal plate, glass, ceramics, wood, or leather, that can be printed on with ink.

Like the terms "print" and "printing" defined above, the term "ink" should be broadly interpreted. The term "ink" should be interpreted as a liquid that can be applied to a printing medium to form images, artwork, or patterns, or to modify a printing medium, or that can be usable for processing ink. Processing of ink may be solidifying or insolubilizing a color material in ink applied to a printing medium.

An overall configuration and a control configuration of a printing apparatus that is used in common in embodiments of the present invention will be described first.

(Configuration of Printing Apparatus)

Figure 4:
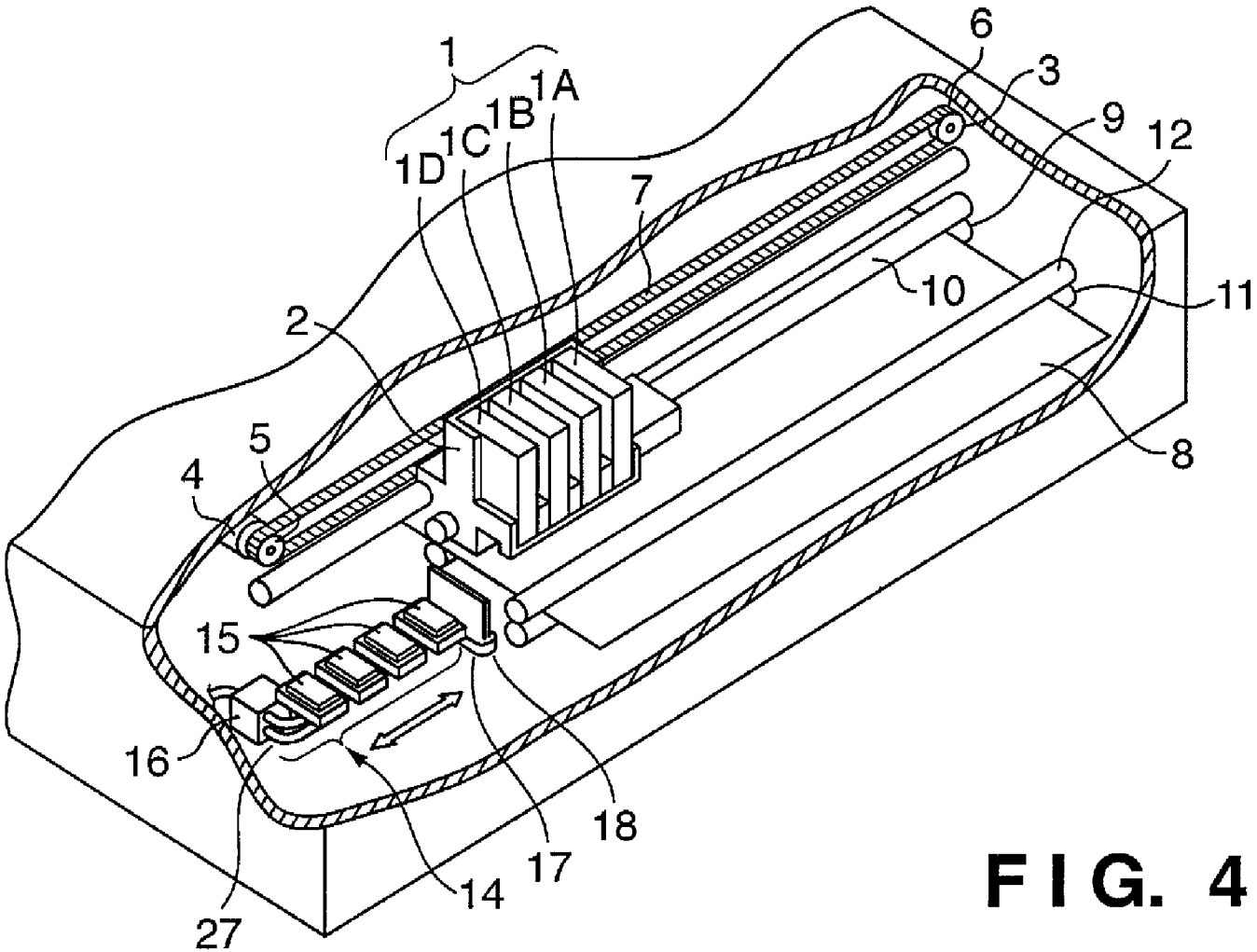
FIG. 4 is a perspective view schematically showing a configuration of an inkjet printing apparatus.

FIG. 4 is a perspective view schematically showing a configuration of an inkjet printing apparatus according to the present invention. In FIG. 4, a head cartridge 1, which is printing means, is detachably attached to a carriage 2. The head cartridge 1 includes four head cartridges 1A, 1B, 1C, and 1D for printing in different kinds of ink.

Figure 1:
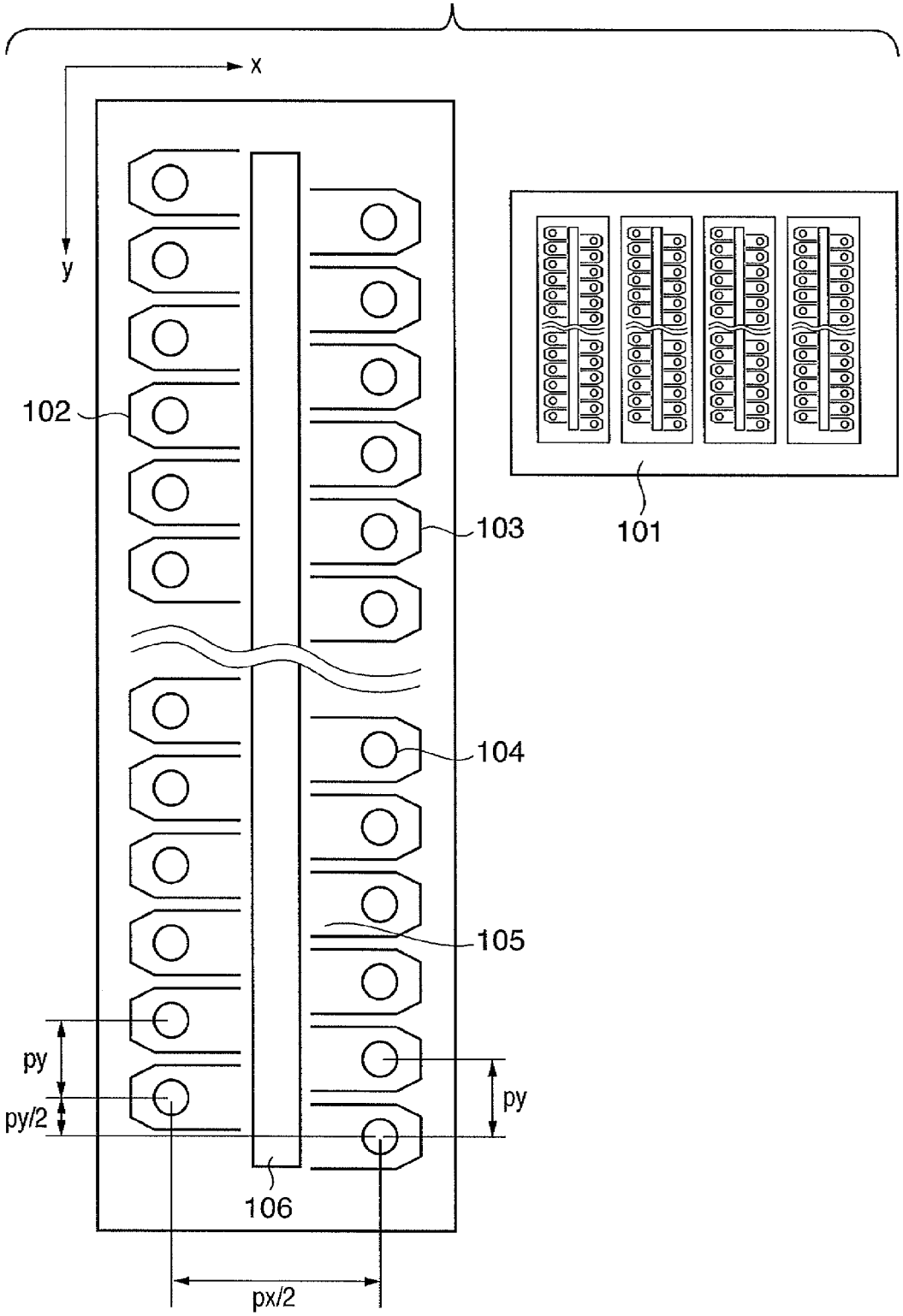
FIG. 1 is a diagram showing arrays of nozzles of an inkjet printhead.
Figure 2:
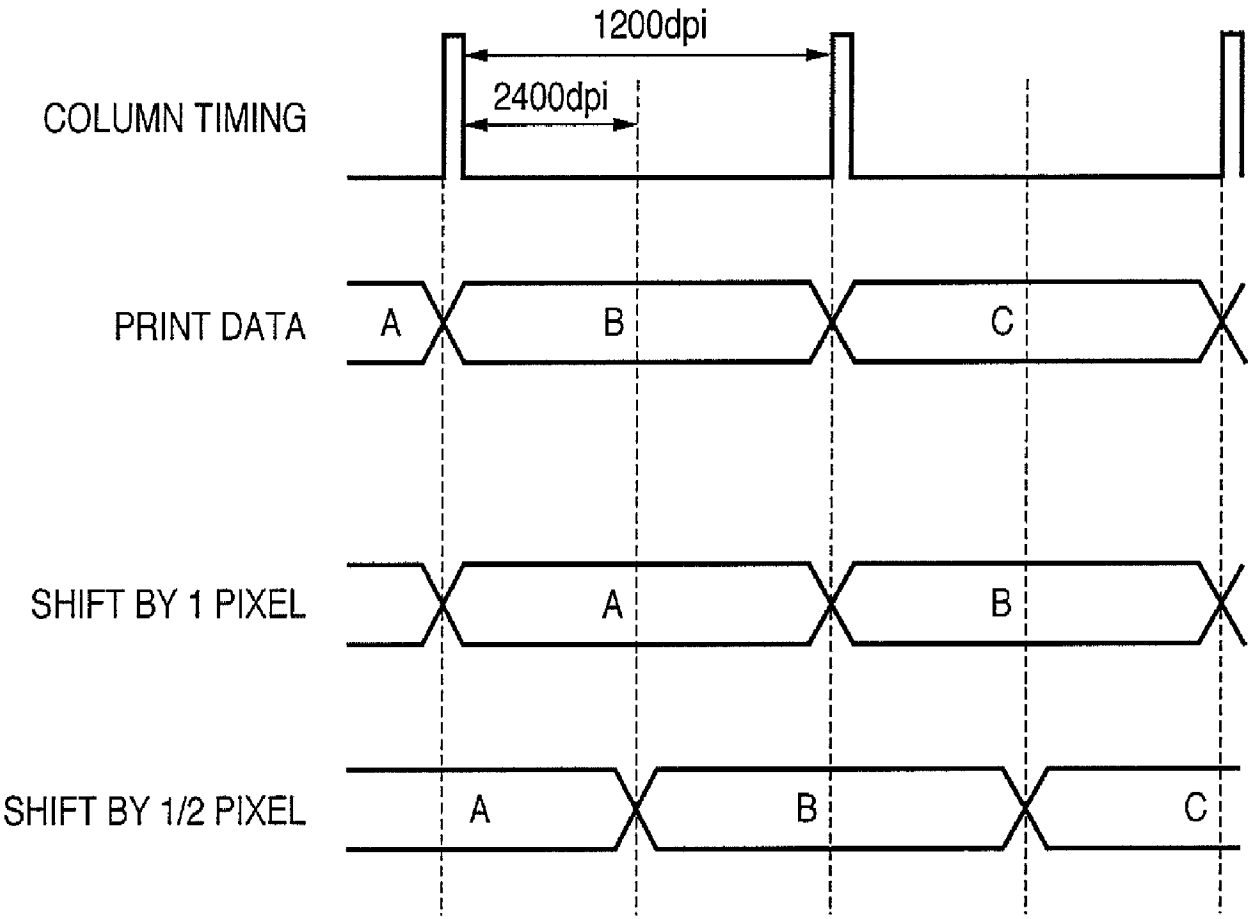
FIG. 2 is a diagram showing that a 2400-dpi shift can be made as a unit when a printhead prints in a scanning direction with 1200 dpi.
Figure 3:
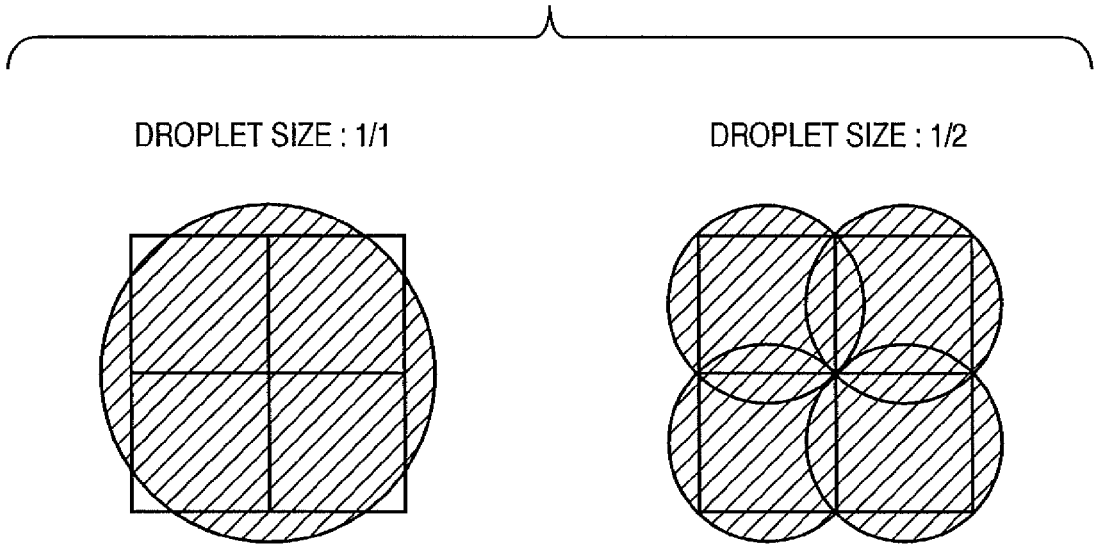
FIG. 3 is a diagram schematically showing the number of dots to be placed in the same print area when the size of a droplet is reduced to ½.

Each of the head cartridges 1A, 1B, 1C, and 1D includes a printhead containing ink nozzles and an ink reservoir for supplying ink to the printhead. Each of the head cartridges 1A, 1B, 1C, and 1D has two nozzle arrays as shown in FIG. 1. An even-numbered nozzle array 102 is disposed to the left of an ink supply path 106 and an odd-numbered nozzle array 103 is disposed to the right of the ink supply path 106. Ink is supplied from the ink supply path 106 to each nozzle 104 through an ink channel 105 associated with the each nozzle 104.

Provided in each of the head cartridges 1A, 1B, 1C, and 1D is a connector for receiving a signal that drives the printhead. In the following description, the head cartridges 1A, 1, 1C, and 1D are collectively referred to or any one of these is referred to simply as head cartridge 1.

Contained in the ink reservoirs of the head cartridges 1 is ink of different colors, for example black, cyan, yellow, and magenta to enable color printing using ink of different colors. The head cartridges 1 are detachably attached to a carriage 2 in predetermined positions. Provided in the carriage 2 is a connector holder (electric connection unit) for transmitting a signal such as a driving signal to the head cartridge 1 through a connector.

The carriage 2 is supported in such a manner that the carriage 2 can move forward and backward along a guide shaft 3 provided on the body of the printing apparatus. The carriage 2 is driven by a carrier motor 4 through a motor pulley 5, a driven pulley 6, and a timing belt 7 in such a manner that its position and movement are controlled by the carrier motor 4. A printing medium 8 is carried (fed) by the rotation of two pairs of covey rollers 9 and 10, and 11 and 12, driven by a conveyer motor, not shown, through a position (printing unit) that faces the nozzle surface of the printhead assembly of the head cartridge 1. The backside of the printing medium 8 is supported by a platen (not shown) so that a flat print surface can be formed on the printing unit. The head cartridges 1 contained in the carriage 2 are supported in such a manner that their nozzle surfaces protrude downward from the carriage 2 and are flat with respect to the printing medium 8 between the two convey roller pairs.

The printhead assembly of the head cartridge 1 is inkjet printing means that discharges ink using thermal energy and includes an electrothermal converter for generating thermal energy. The printhead assembly of the head cartridge 1 discharges ink through nozzles to print by using pressure change caused by expansion and shrinkage of air generated by film boiling caused by thermal energy applied by the electrothermal converter.

Reference numeral 14 denotes a restoring mechanism that performs a restoring operation for restoring the discharge capability of the printhead assembly of the head cartridge 1. Provided in the restoring mechanism are caps 15 that cover the surface of nozzles to prevent ink from evaporating when the printhead assembly returns to its home position and a suction pump 16 connected with the caps 15 through a tube 27. Also provided are a blade 18 for cleaning off dust and ink sticking on the nozzle surface and a blade holder 17 for holding the blade 18.

Restoring operation is performed at regular intervals so that the discharge surface of the printhead assembly of each head cartridge 1 is cleaned with the blade 18. The discharge surface of each printhead assembly is moved to a position covered by the associated cap 15 as needed and ink which becomes viscous at the nozzle is drawn by the suction pump 16 and a ink droplet is forced out.

While the present embodiments will be described with respect to a configuration that uses electrothermal converter that generates thermal energy as means for discharging ink, the present invention is not limited to this; a configuration that uses a piezoelectric element may be used.

(Configuration of Control System)

Figure 5:
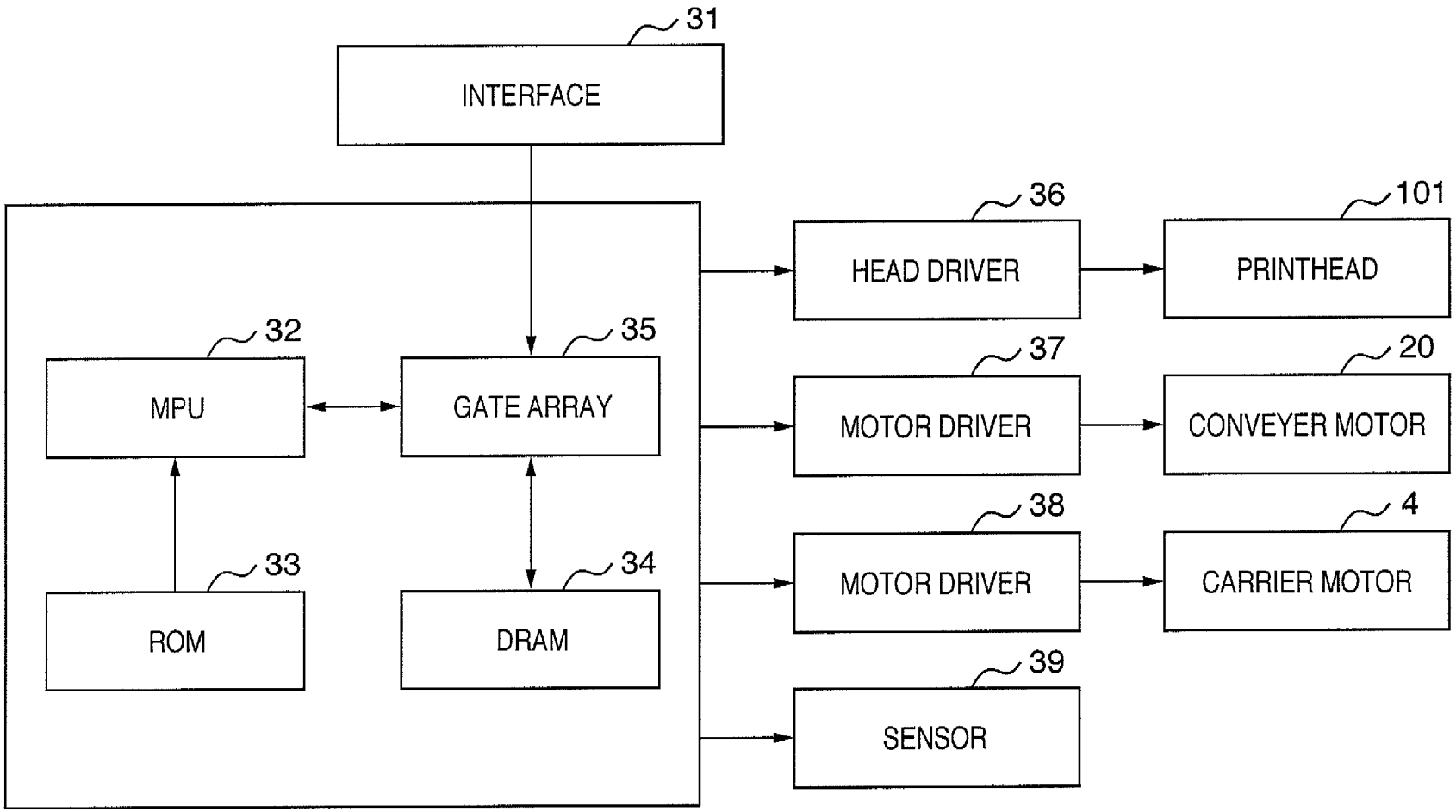
FIG. 5 is a block diagram showing a configuration of a control system of the inkjet printing apparatus.

FIG. 5 is a block diagram showing a configuration of a control system of an inkjet printing apparatus according to the present invention.

In FIG. 5, reference numeral 31 denotes an interface through which a printing signal is input from a host apparatus connected. Reference numeral 32 denotes a microprocessor unit (MPU) and reference numeral 33 denotes a program ROM storing a control program executed by the MPU 32. Reference numeral 34 denotes a DRAM for storing print signals and various kinds of data such as print data provided to a printhead 101.

The DRAM 34 also can store (count) the number of print dots and printing time. Reference numeral 35 denotes a gate array which controls supply of print data to the printhead 101 and also controls data transmission between the interface 31, the MPU 32, and the DRAM 34.

In FIG. 5, reference numeral 4 denotes a carrier motor (main-scanning motor) for conveying the carriage 2 containing the printhead 101 and reference numeral 20 denotes a conveyer motor for conveying a printing medium 8 such as printing paper. Reference numeral 36 denotes a head driver for driving the printhead 101, reference numeral 37 denotes a motor driver for driving the conveyer motor 20, reference numeral 38 denotes a motor driver for driving the carrier motor 4, and reference numeral 39 denotes sensors for various kinds of detection.

The sensors 39 may include a sensor for detecting the presence of a printing medium 8, a sensor for detecting that the carriage 2 is at its home position, and a sensor for sensing the temperature of the printhead 101. With these sensors, the presence of a printing medium 8, the position of the carriage 2, ambient temperature and so on can be recognized.

When print data is sent from the host apparatus through the interface 31, the print data is temporarily stored in the DRAM 34 through the gate array 35 in FIG. 5. Then, the raster data in the DRAM 34 is converted by the gate array 35 into print data to be printed by the printhead 101, and is stored in the DRAM 34. The data is sent by the gate array 35 back to the printhead 101 through the head driver 36 to cause a nozzle at the position corresponding to the data to discharge ink to print. A counter is provided in the gate array 35 for counting dots to be printed so that dots to be printed can be counted at a high speed.

The carrier motor 4 is driven through the motor driver 38 to move the carriage 2 in the main scanning direction in tune with the printing speed of the printhead 101 to print for one scan in the main scanning direction. Upon completion of the printing in the main scanning direction, the conveyer motor 20 is driven through the conveyer motor driver 37 to convey (feed) the printing medium 8 in the direction (sub-scanning direction) perpendicular to the main scanning direction by a predetermined pitch.

Then, in order to print for the next scan, the carrier motor 4 is driven again through the motor driver 38 to move the carriage 2 in the main scanning direction in tune with the printing speed of the printhead 101 to perform printing in the main scanning direction (the next main scan). This process is repeated to complete printing throughout the printing medium 8.

First Exemplary Embodiment

A first exemplary embodiment will be described below in which the present invention is applied to an inkjet printing apparatus having the configuration described above.

The printing apparatus in the first exemplary embodiment includes a printhead having two types of nozzles that discharge the same amount of ink but have different discharge characteristics, and has a printing mode in which the two types of nozzles are driven at the same timing (column timing) in the same main scanning direction for printing. The difference of discharge characteristics is differences of discharge speed.

Figure 6:
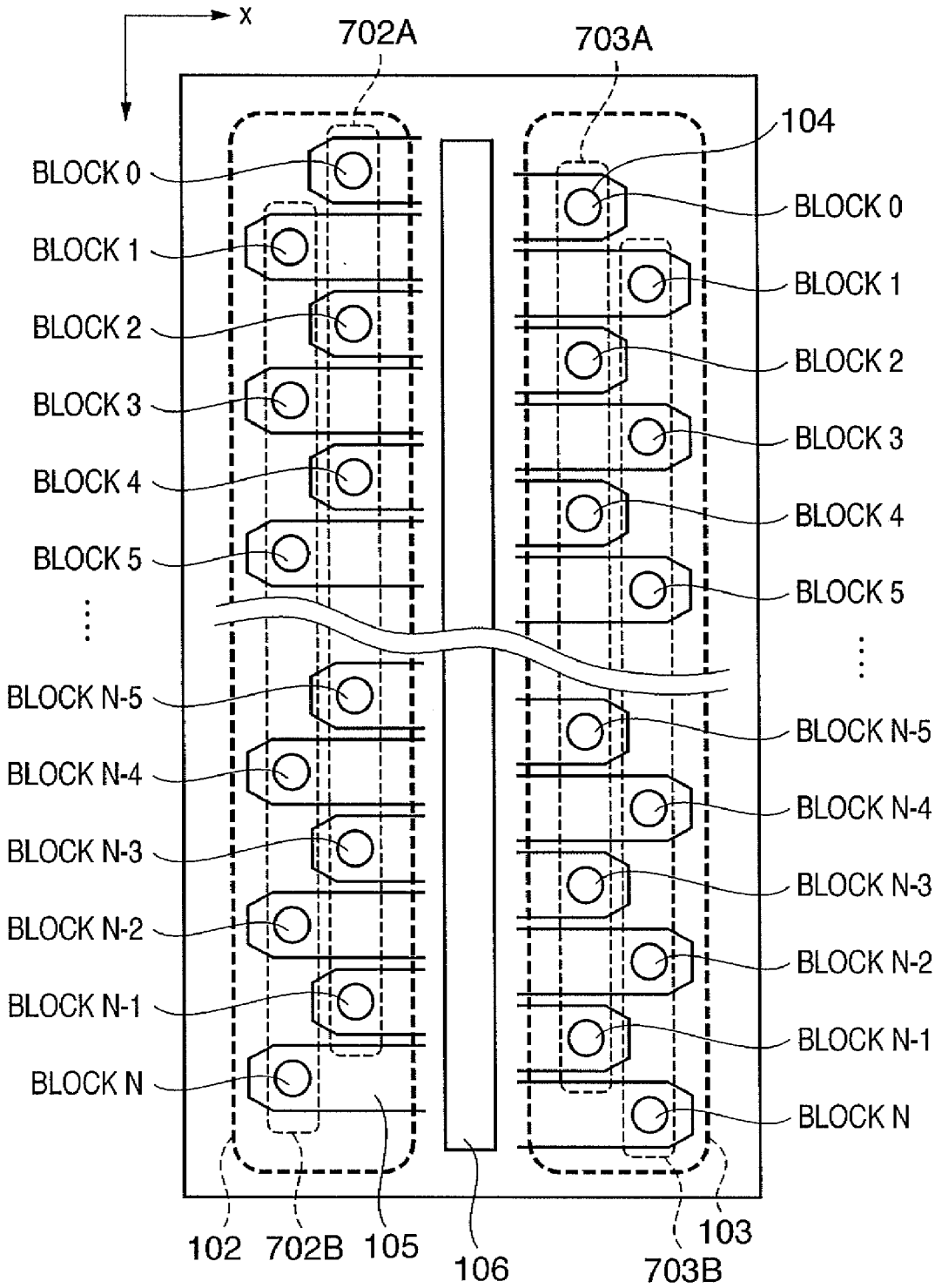
FIG. 6 is a diagram showing an example of a nozzle array of a printhead of an inkjet printing apparatus in a first exemplary embodiment.

FIG. 6 shows exemplary nozzle arrays of a printhead 101 of the inkjet printing apparatus according to the first exemplary embodiment. The printhead 101 includes multiple nozzle arrays. Nozzle array 102 to the left of an ink supply path 106 is an even-numbered nozzle array in which an even number is assigned to each nozzle for convenience. Nozzle array 102 consists of nozzle groups 702A and 702B. Nozzle array 103 to the right of the ink supply path 106 is an odd-numbered nozzle array in which an odd number is assigned to each nozzle for convenience. Nozzle array 103 consists of nozzle groups 703A and 703B. The even-numbered and odd-numbered nozzle arrays 102 and 103 are arranged in staggered fashion. Nozzle groups 702A and 702B are connected to a common data signal line and nozzle groups 703A and 703B are connected to another common data signal line. Multiple blocks (blocks 0 to N) are allocated to the even-numbered nozzle array 102. The odd-numbered nozzle array 103 has the same configuration. In particular, nozzle groups 702A and 703A are divided into blocks 0, 2, 4 . . . , (N−1) and nozzle groups 702B and 703B are divided into blocks 1, 3, 5, . . . , N.

The even-numbered and odd-numbered nozzle arrays 102 and 103 use a common driving signal line. Ink is supplied from the ink supply path 106 through an ink channel 105 associated with each of the nozzle arrays 102 and 103.

A state in which this head is used to print will be described below.

In the printhead configuration used in the present exemplary embodiment, the even-numbered and odd-numbered nozzle arrays are arranged in staggered fashion and the nozzle arrays such as nozzle arrays 102 and 103, or nozzle groups such as nozzle groups 702A and 702B have different discharge characteristics. The difference in discharge characteristics is due to the difference in distance between the nozzles and ink supply path (the length of the ink channel) and it is difficult to eliminate the difference in the discharge characteristics. In the first exemplary embodiment, when the printing elements of the nozzle array 102 are driven at the same timing, the discharge speed of ink droplets discharged from the nozzle group 702A is higher than the discharge speed of ink droplets discharged from the nozzle group 702B.

Similarly to the even-numbered nozzle array 102, the odd-numbered nozzle array 103 includes nozzle groups 703A and 703B having different discharge speeds, and nozzle groups 703A and 703B discharge ink droplets in the same main scanning direction in a set order of blocks.

Figure 7:
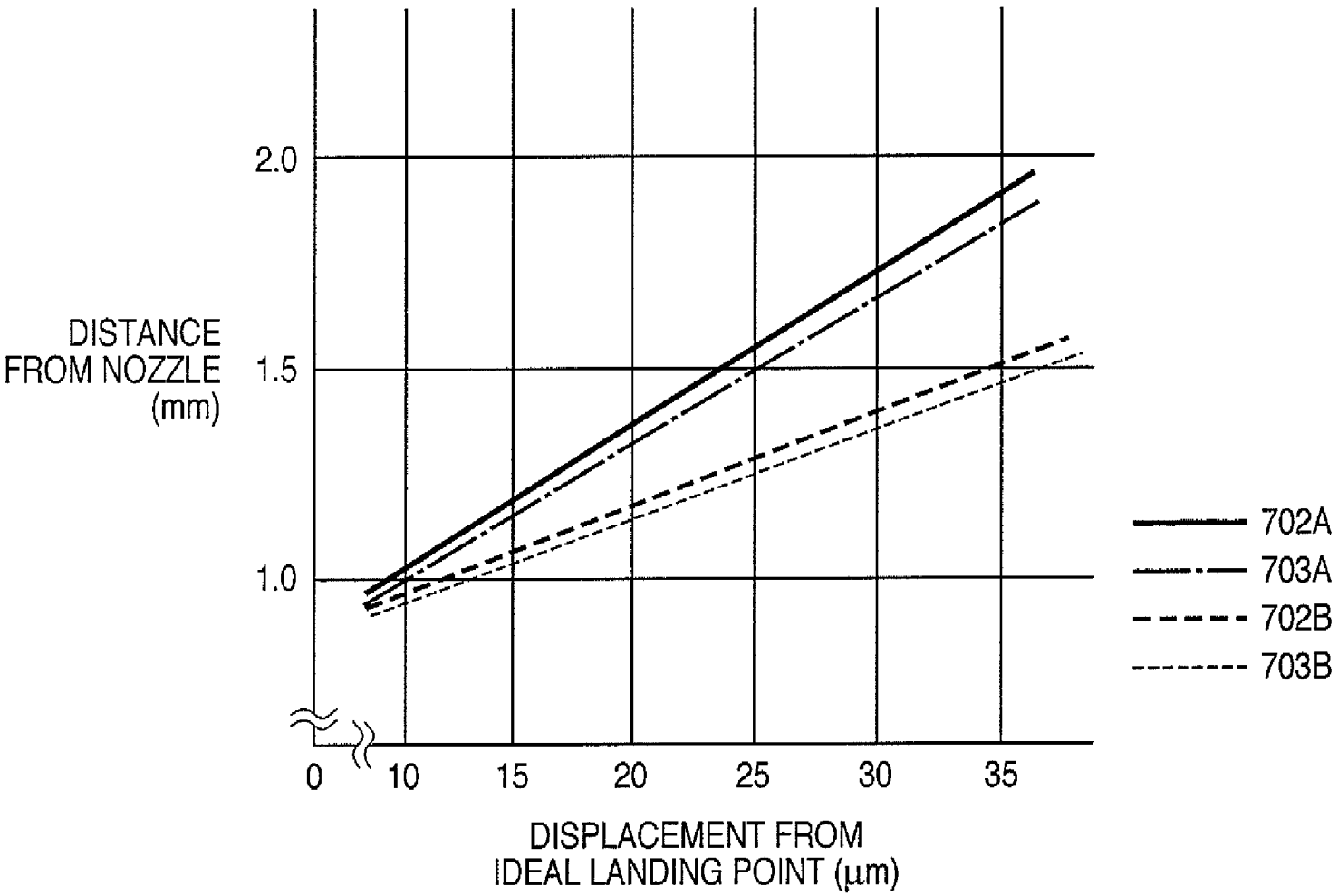
FIG. 7 is a graph of the distance between an ink dot discharged from a nozzle array of a printhead and the nozzle, versus displacement of the droplet from ideal landing point on a printing medium at that distance in the first exemplary embodiment.

FIG. 7 schematically shows the distance between each nozzle and the surface of a printing medium being a landing point of an ink droplet discharged from the nozzle array of the printhead in the first exemplary embodiment, versus displacement from an ideal landing point on the printing medium at the distance. As shown in FIG. 7, the displacements from the ideal landing points of nozzle group 702B are greater than those of nozzle group 702A.

Figure 8:
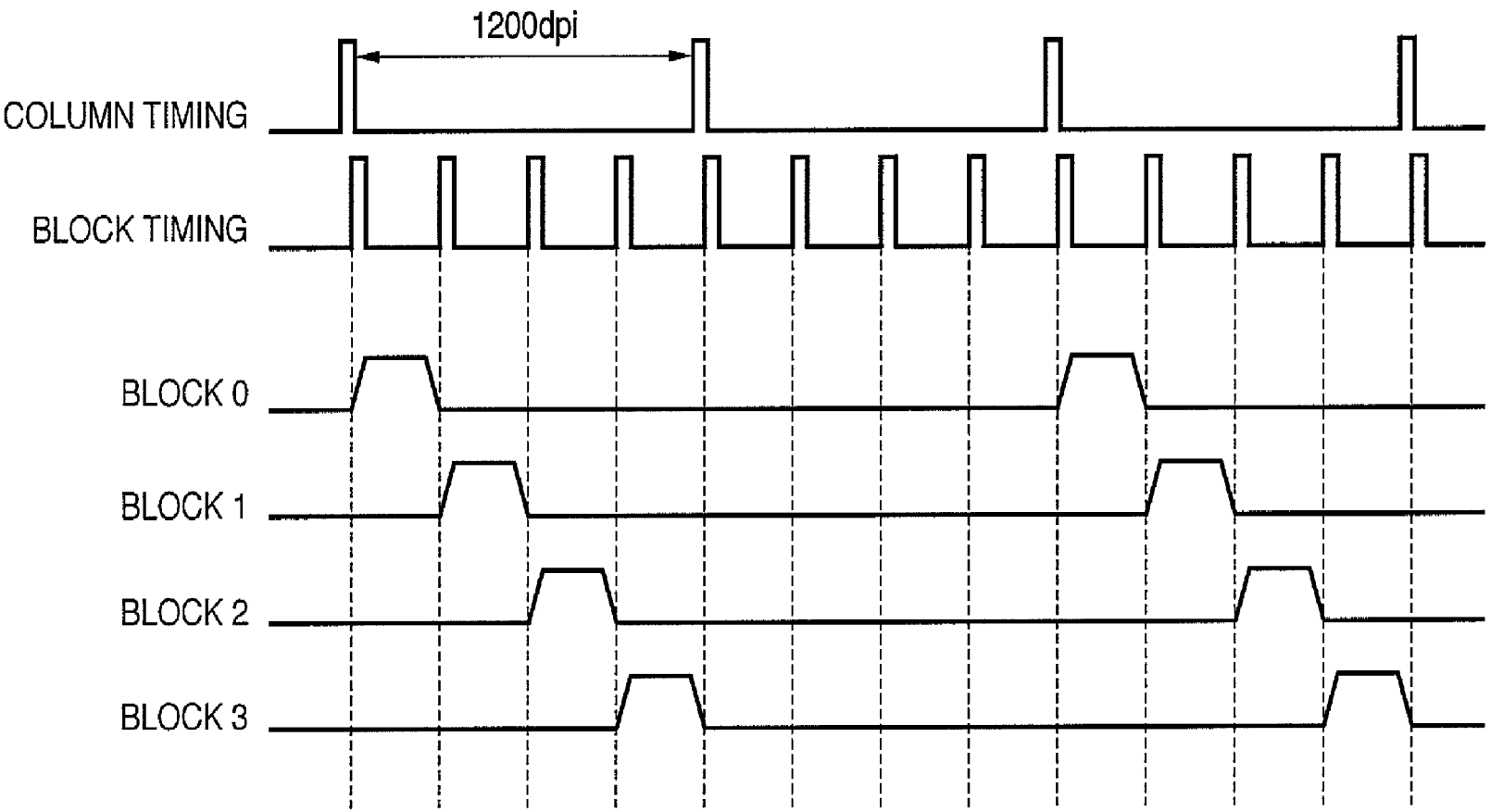
FIG. 8 is a timing chart of driving blocks associated with nozzles of a printhead, showing how the driving blocks are time-divisionally driven in the first exemplary embodiment and a second exemplary embodiment.

The printhead of the exemplary embodiment has a configuration as shown in FIG. 6. Four adjacent nozzles are divided into four driving blocks. For example, four blocks 0 to 3 are driven in a set time-divisional driving order to discharge ink. FIG. 8 shows a timing chart of an example in which driving blocks associated with four nozzles of nozzle array 102 are driven in a time-divisional manner. Here, column timing is time allocated to an entire nozzle array for printing with a printing density of 1200 dpi. Block timing is time allocated to each block for printing with a printing density of 1200 dpi. Here, the order in which blocks are driven was set such that block 0, block 1, block 2, and block 3 are driven in this order. Misregistration between landing points of the nozzle groups 702A and 702B caused by the arrangement offset (staggered arrangement) between nozzle groups 702A and 702B in the scanning direction of the printhead is compensated by shifting driving timing beforehand so that ink droplets land in the same column.

Figure 9:
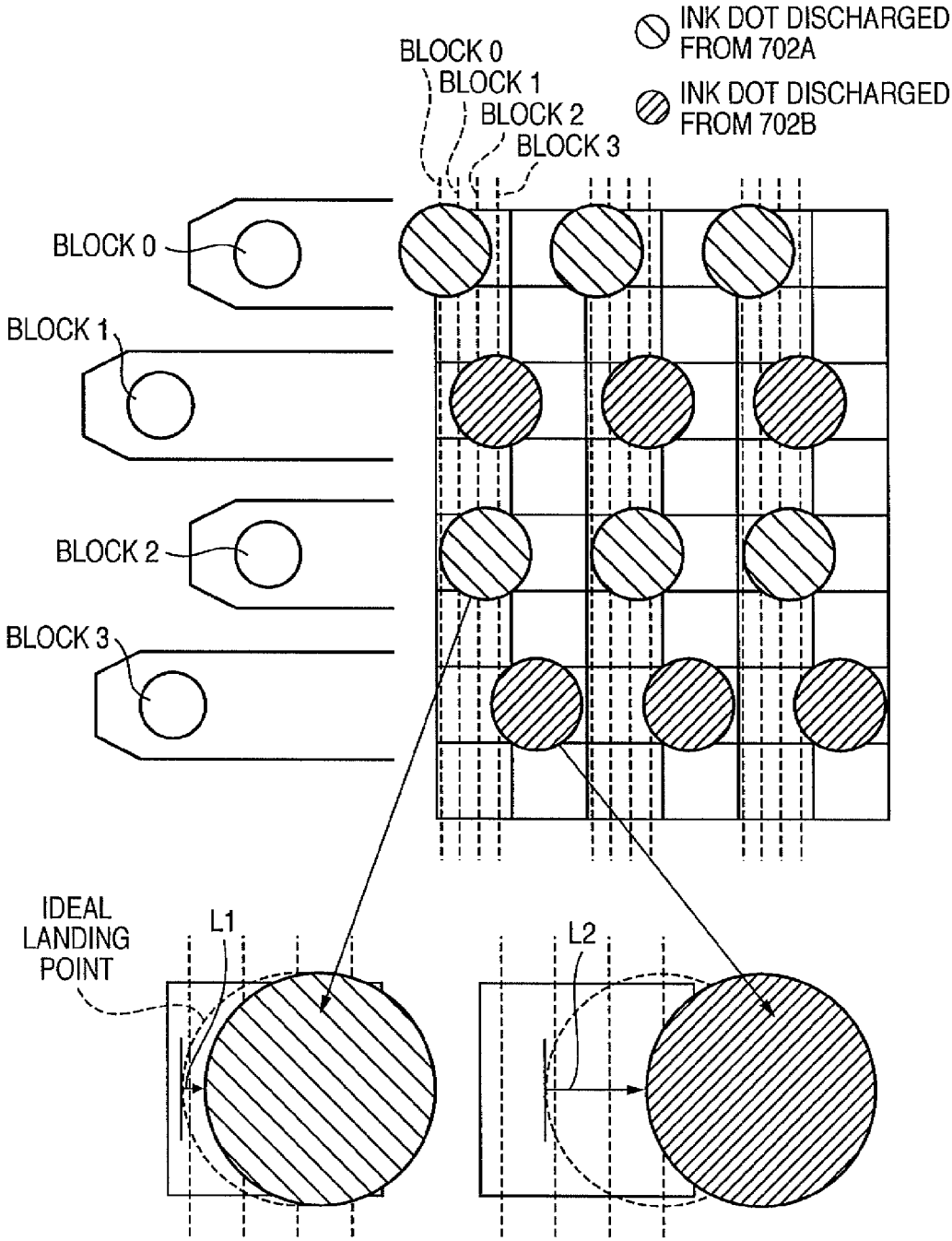
FIG. 9 is a diagram schematically showing how dots of ink discharged from nozzles are formed on a print matrix in the first exemplary embodiment.

As the printhead moves from left to right in FIG. 9, ink droplets discharged from nozzles form ink dots as shown in FIG. 9. A grid-like diagram indicating positions in which ink dots are formed in this way is referred to as print matrix herein. In FIG. 9, discharge positions of ink droplets discharged from the printhead at block timings of blocks 0 to 3 are indicated by dashed lines. The vertical and horizontal pitches of the print matrix are values (approximately 21.2 μm) corresponding to 1200 dpi. Shifting driving timing by 1 is equivalent to shifting landing points of ink droplets by a distance (approximately 21.2 μm) equivalent to one dot corresponding to 1200 dpi.

The discharge speed of ink droplets discharged from nozzle group 702A differs from that of the nozzle group 702B. Accordingly, the misregistration (L2) of an ink dot formed on the print matrix by nozzle group 702B is greater than the misregistration (L1) of an ink dot formed by nozzle group 702A and the dots are relatively displaced toward the right-hand side of FIG. 9.

A printed material printed by driving all nozzle arrays as described above was visually checked and fine streaks and moire-like unevenness were found in the vertical direction. Driving was performed so that each ink droplet discharged has a size of 2.8±0.3 pl. Ink containing color materials for a commercially available inkjet printer, iP4200 (from Canon Inc.), was used. The printing medium used was A4-sized gloss paper for inkjet printing (Pro Photo Paper PR-101 from Canon Inc.). The scan speed of the carriage was 25 inches/second. The image printed was a photograph-like image.

Figure 10:
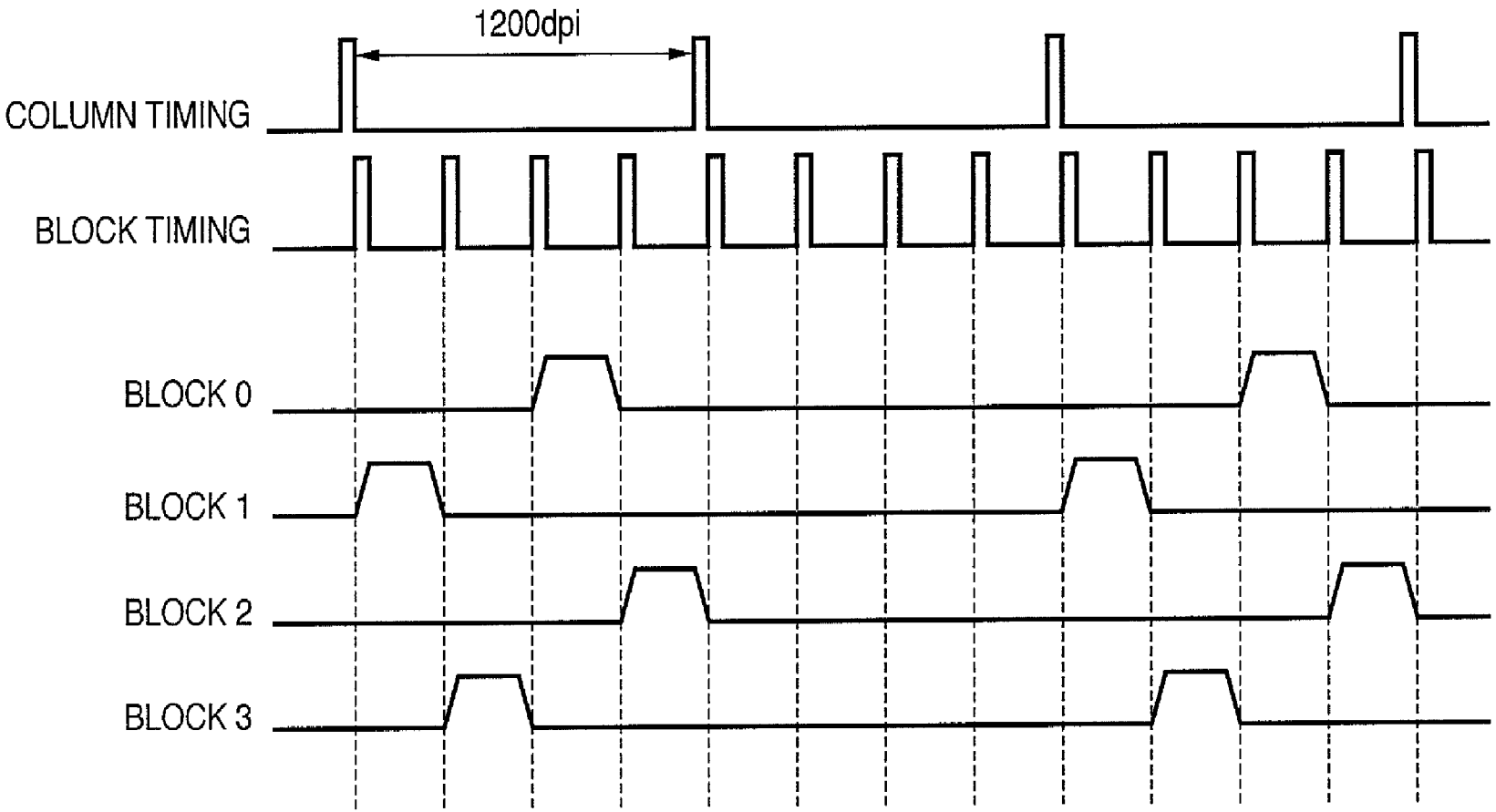
FIG. 10 is another timing chart of driving blocks associated with nozzles of a printhead, showing how the driving blocks are time-divisionally driven in the first and second exemplary embodiments.

FIG. 10 is a timing chart of an example in which driving blocks associated with the four nozzles of nozzle array 102 in the present exemplary embodiment are driven in a time-divisional manner. Considering misregistration of landing points caused by a relative difference between nozzle group 702A and nozzle group 702B in discharge speed, the order in which driving blocks are driven was set such that blocks 1, 3, 0, and 2 are driven in this order. Again, misregistration of landing points caused by the arrangement offset (staggered arrangement) between nozzle groups 702A and 702B in the scanning direction is compensated by shifting driving timing beforehand so that ink droplets land in the same column.

Figure 11:
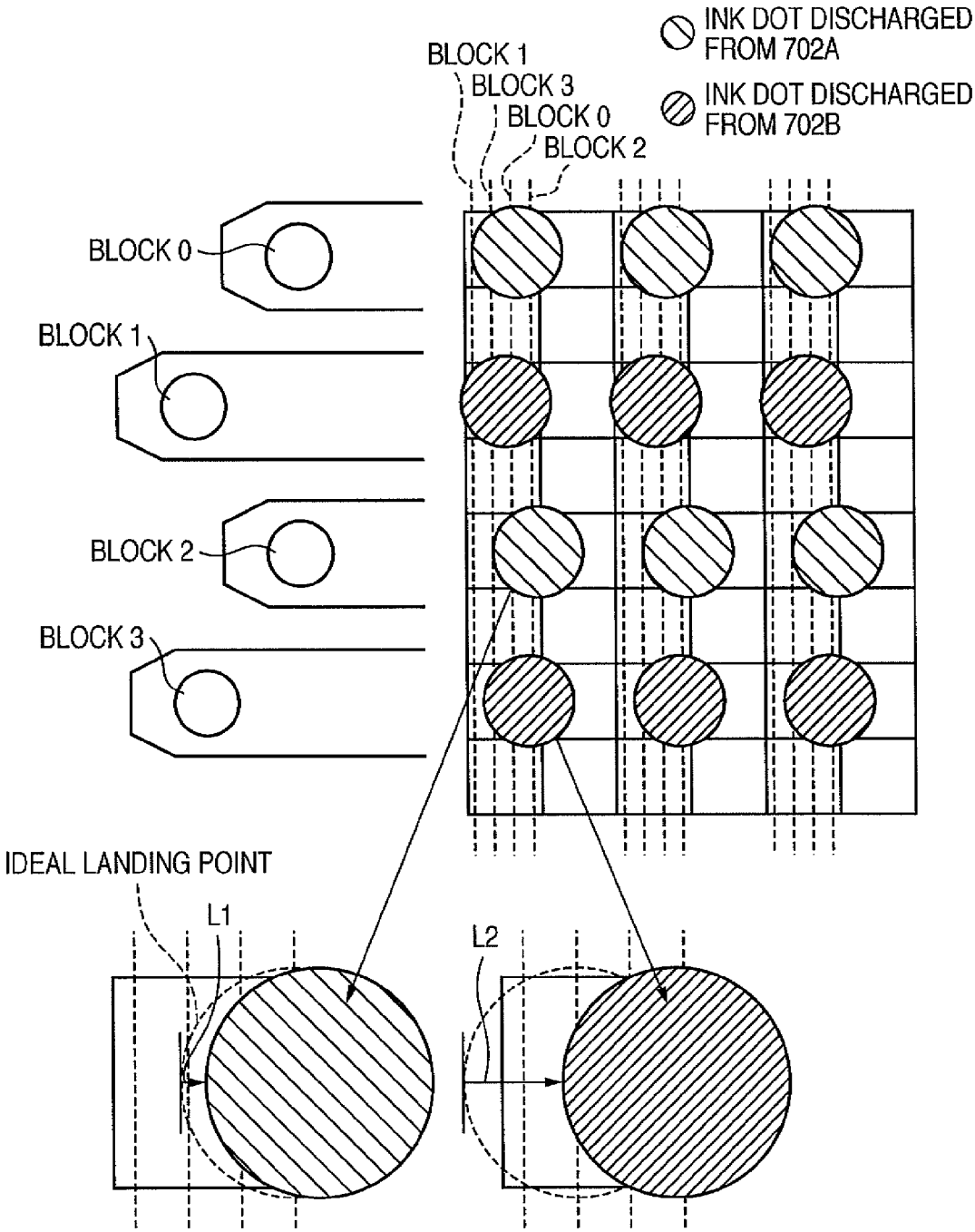
FIG. 11 is another diagram schematically showing how dots of ink discharged from nozzles are formed on a print matrix in the first exemplary embodiment.

As the printhead moves from left to right in FIG. 11, ink droplets discharged from nozzles form ink dots on the print matrix as shown in FIG. 11.

As apparent from FIG. 11, all ink dots on the print matrix are placed in desired positions on the print matrix because the driving order is set so that misregistration of landing points caused by the difference between nozzle arrays 702A and 702B in discharge speed is reduced. While the printing has been described in which the printhead moves from left to right in FIG. 11, all ink dots are placed in desired positions in a print matrix by setting a driving order in the similar way when the printhead moves from right to left in FIG. 11.

Visual checking of a printed material printed by driving all the nozzle arrays as described above under otherwise the same printing conditions that are shown in the timing chart of FIG. 8 showed that a high-quality image without streaks and unevenness can be obtained.

Second Exemplary Embodiment

A second exemplary embodiment of the present invention will be described below.

The printing apparatus of the second exemplary embodiment includes a printhead having two types of nozzle groups that discharge different amounts of ink, and has a print mode in which the two types of nozzle groups are driven at the same timing (column timing) in scanning by the same printhead for printing.

Figure 12:
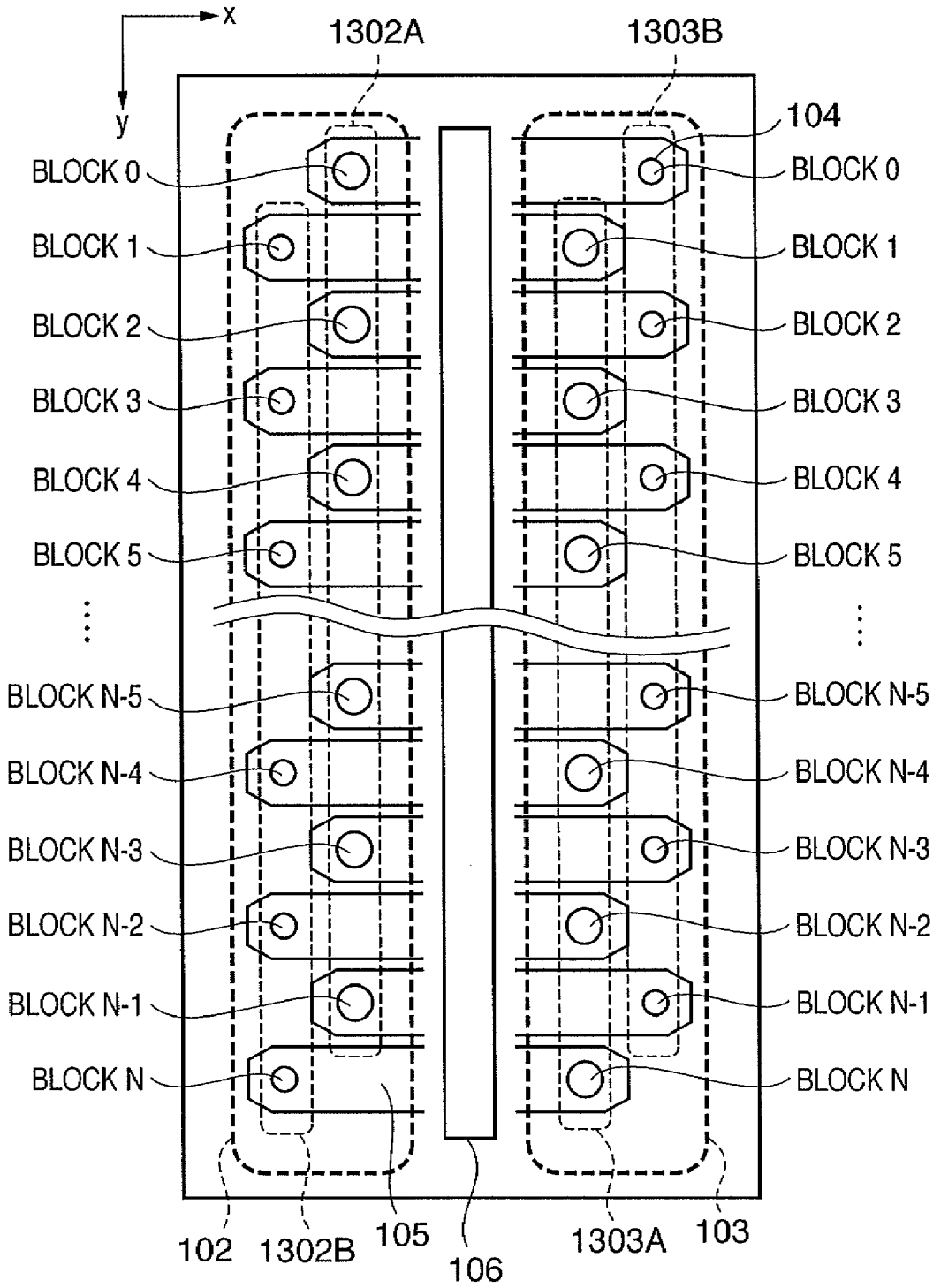
FIG. 12 is a diagram showing nozzle arrays of a printhead of an inkjet printing apparatus in the second exemplary embodiment.

FIG. 12 shows exemplary arrays of nozzles of the printhead 101 having multiple nozzle arrays 102, 103. Large-diameter nozzle groups 1302A, 1303A that discharge a larger amount of ink and are used for printing larger print dots and small-diameter nozzle groups 1302B, 1303B that discharge a smaller amount of ink and are used for printing smaller print dots are disposed in the nozzle arrays 102, 103. The two types of nozzles that have a smaller diameter and a larger diameter are arranged in staggered fashion in the two nozzle arrays 102, 103. Even-numbered nozzle array 102 (nozzle groups 1302A, 1302B) is disposed to the left of an ink supply path 106 and odd-numbered nozzle array 103 (nozzle groups 1303A, 1303B) is disposed to the right of the ink supply path 106. In particular, in the even-numbered nozzle array 102, nozzle group 1302A discharges a greater amount of ink than nozzle group 1302B and therefore forms larger print dots. Like the even-numbered nozzle array 102, the odd-numbered nozzle array 103 includes a large-diameter nozzle group 1303A and a small-diameter nozzle group 1303B that discharge different amounts of ink and even-numbered nozzle array 102 and odd-numbered nozzle array 103 are arranged in such a manner that the large-diameter nozzles and small-diameter nozzles are arranged alternately.

The even-numbered and odd-numbered nozzle arrays are arranged in staggered fashion and nozzle groups 1302A and 1302B are connected to a common data signal line and nozzle groups 1303A and 1303B are connected to another common data signal line. Multiple blocks (blocks 0 to N) are allocated to the even-numbered nozzle array 102. The odd-numbered nozzle array 103 has the same configuration, except that the order in which blocks are allocated differs because the positional relationship between the larger-diameter nozzles and smaller-diameter nozzles differs from that of the even-numbered nozzle array 102. Specifically, in the even-numbered array, the large-diameter nozzle group 1302A is divided into blocks 0, 2, 4, . . . , (N−1) and the small-diameter nozzle group 1302B is divided into blocks 1, 3, 5, . . . , N. In the odd-numbered array, the large-diameter nozzle group 1303A is divided into blocks 1, 3, 5, . . . , N, and the small-diameter nozzle group 1303B is divided into blocks 0, 2, 4, . . . , (N−1). The even-numbered nozzle array 102 and the odd-numbered nozzle array 103 are connected to a common driving signal line. Ink is supplied from the ink supply path 106 to each nozzle 104 through an ink channel 105 associated with the each nozzle 104.

Printing performed using this printhead will be described below.

In the second exemplary embodiment, the nozzle groups in the even-numbered nozzle array 102 and the odd-numbered nozzle array 103 print ink dots of different sizes and their discharge characteristics significantly differ from each other. When the nozzle array 102 is driven at the same timing in one scan of printing, the initial discharge speeds of ink droplets discharged from the large-diameter nozzle group 1302A and small-diameter nozzle group 1302B are approximately the same. However, ink droplets from the small-diameter nozzle group 1302B experience a greater air resistance during the flying time period before they land on a printing medium than ink droplets from the large-diameter nozzle group 1302A. Accordingly, the speed of the ink droplets discharged from the small-diameter nozzle group 1302B is significantly reduced before they land.

Figure 13A:
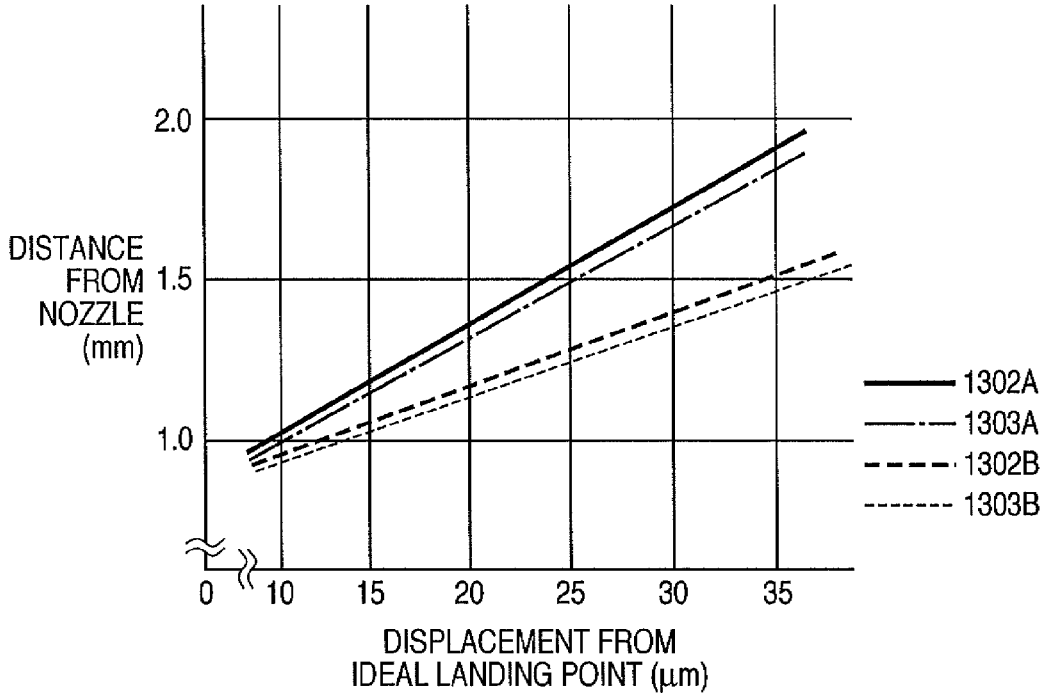
FIG. 13A is a graph of the distance between an ink dot discharged from each nozzle of a printhead and the nozzle, versus displacement of the ink dot from an ideal landing point on a printing medium at that distance in the second exemplary embodiment.
Figure 13B:
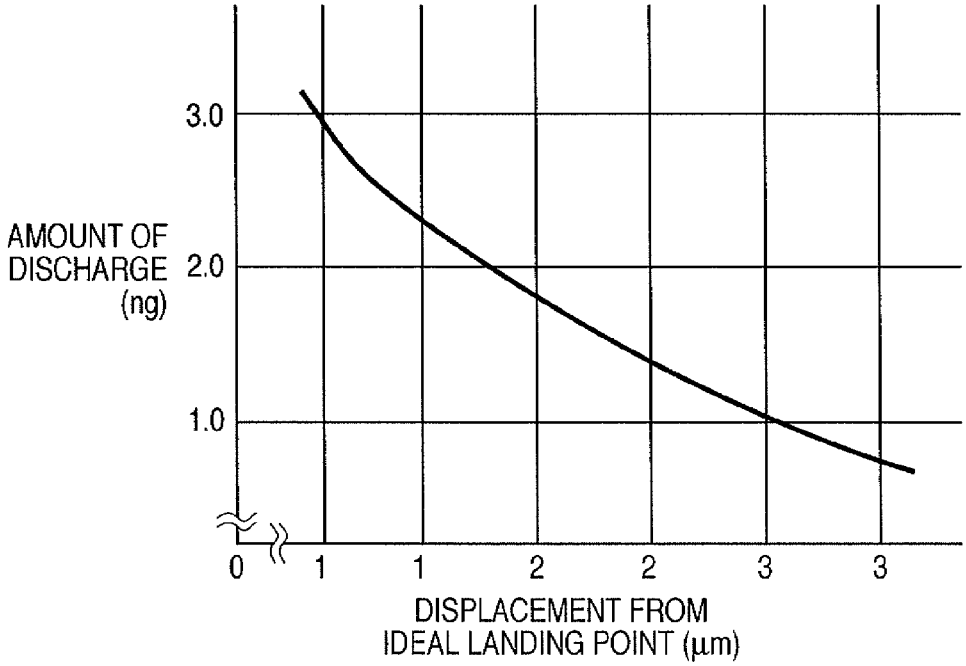
FIG. 13B is a graph of the amount of an ink droplet (ng) discharged from each nozzle of a printhead, versus displacement of the dot from an ideal landing point on a printing medium at a given distance from the nozzle.

FIG. 13A schematically shows the distance between a nozzle and the surface of a printing medium being a landing point of an ink droplet discharged from the nozzle array of the printhead, versus displacement from an ideal landing point on the printing medium at the distance. FIG. 13B schematically shows the amount of ink discharged (ng), versus displacement from an ideal landing point on the printing medium at a given distance. As shown in FIG. 13A, the displacement of an ink dot of the small-diameter nozzle group 1302B from the ideal landing point is greater than that of the large-diameter nozzle group 1302A. Like the even-numbered nozzle array 102, the odd-numbered nozzle array 103 has a large-diameter nozzle group 1303A and a small-diameter nozzle group 1303B. Ink droplets are discharged from the large-diameter nozzle group 1303A and the small-diameter nozzle group 1303B in a predetermined order of blocks during scanning of the same printhead.

The printhead has a configuration as described above and shown in FIG. 12. Four adjacent nozzles are divided into four driving blocks. For example, four blocks 0 to 3 are driven in a set time-divisional driving order to discharge ink. FIG. 8 shows a timing chart of an example in which driving blocks associated with four nozzles of nozzle array 102 are driven in a time-divisional manner. The order in which blocks are driven was set such that block 0, block 1, block 2, and block 3 are driven in this order. Misregistration of landing points between nozzle groups 1302A and 1302B caused by the arrangement offset (staggered arrangement) between nozzle groups 1320A and 1302B in the scanning direction is compensated by shifting driving timing beforehand so that ink droplets land in the same column.

Figure 14:
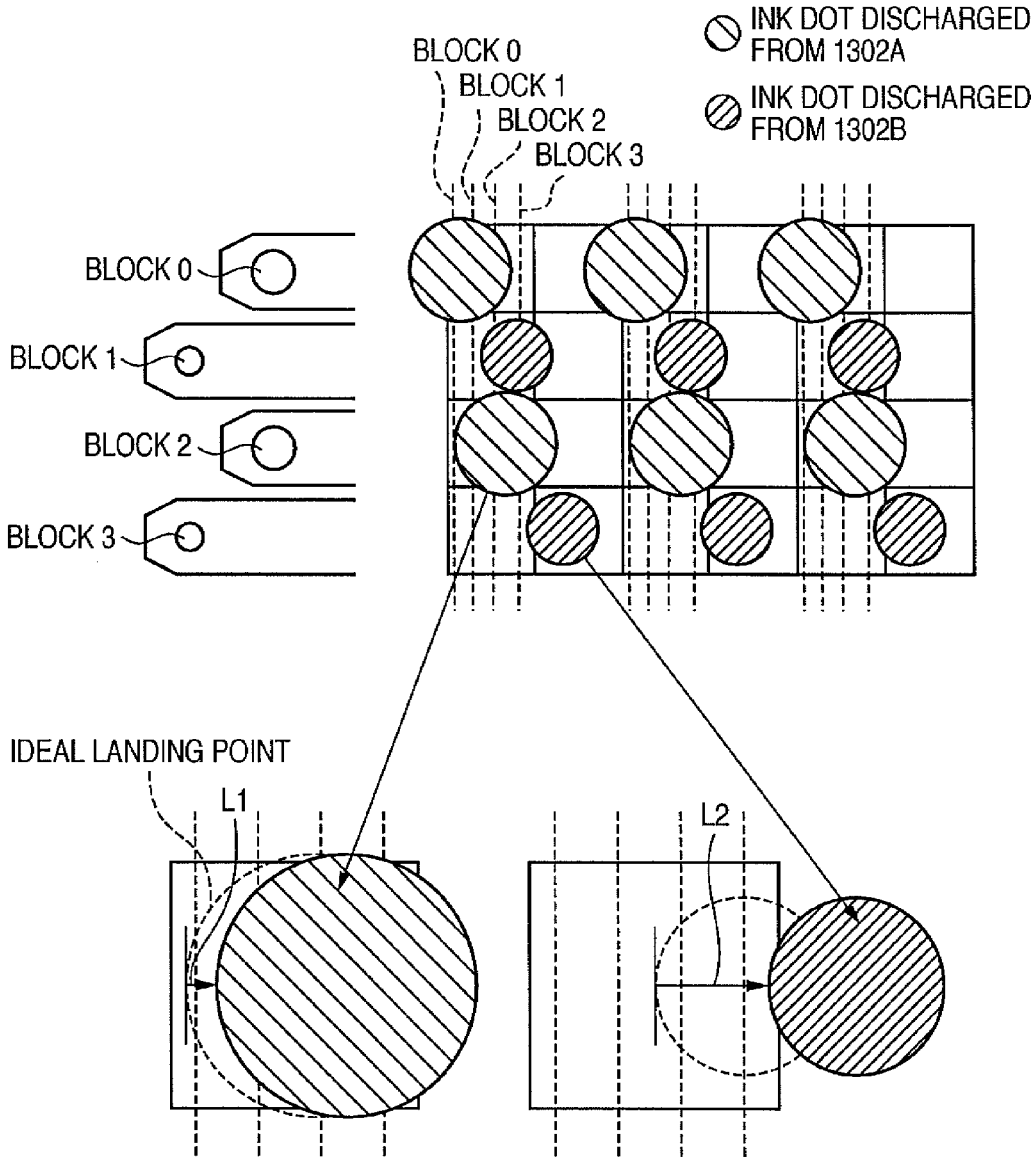
FIG. 14 is a diagram schematically showing how dots of ink discharged from nozzles are formed on a print matrix in the second exemplary embodiment.

As the printhead moves from left to right in FIG. 14, ink droplets discharged from nozzles form ink dots as shown in FIG. 14. In FIG. 14, positions where ink droplets discharged from the printhead at block timing of blocks 0 to 3 are placed are indicated by dashed lines.

As apparent from FIG. 14, there is a significant difference between the discharge speed reduction of ink droplets discharged from nozzle group 1302A and that of the nozzle group 1302B. Accordingly, the ink dots formed by the small-diameter nozzle group 1302B on the print matrix are relatively displaced toward the right-hand side of FIG. 14.

A printed material printed by driving all nozzle arrays as described above was visually checked and fine streaks and moire-like unevenness were found in the vertical direction. Driving is performed so that each large ink droplet discharged has a size of 2.8±0.3 pl and each small ink droplet discharged has a size of 1.0±0.2 pl. Ink containing color materials for a commercially available inkjet printer, iP4200 (from Canon Inc.), was used. The printing medium used was A4-sized gloss paper for inkjet printing (Pro Photo Paper PR-101 from Canon Inc.). The scan speed of the carriage was 25 inches/second. The image printed was a photograph-like image.

FIG. 10 is a timing chart of an example in which driving blocks associated with the four nozzles of nozzle array 102 in the present exemplary embodiment are driven in a time-divisional manner. Here, considering misregistration of landing points caused by a difference between large-diameter nozzle group 1302A and small-diameter nozzle group 1302B in speed reduction before the ink dots land, the order in which driving blocks are driven is set such that blocks 1, 3, 0, and 2 are driven in this order. Again, misregistration of landing points caused by the arrangement offset (staggered arrangement) between the nozzle groups 1302A and 1302B in the scanning direction is compensated by shifting driving timing beforehand so that ink droplets land in the same column.

Figure 15:
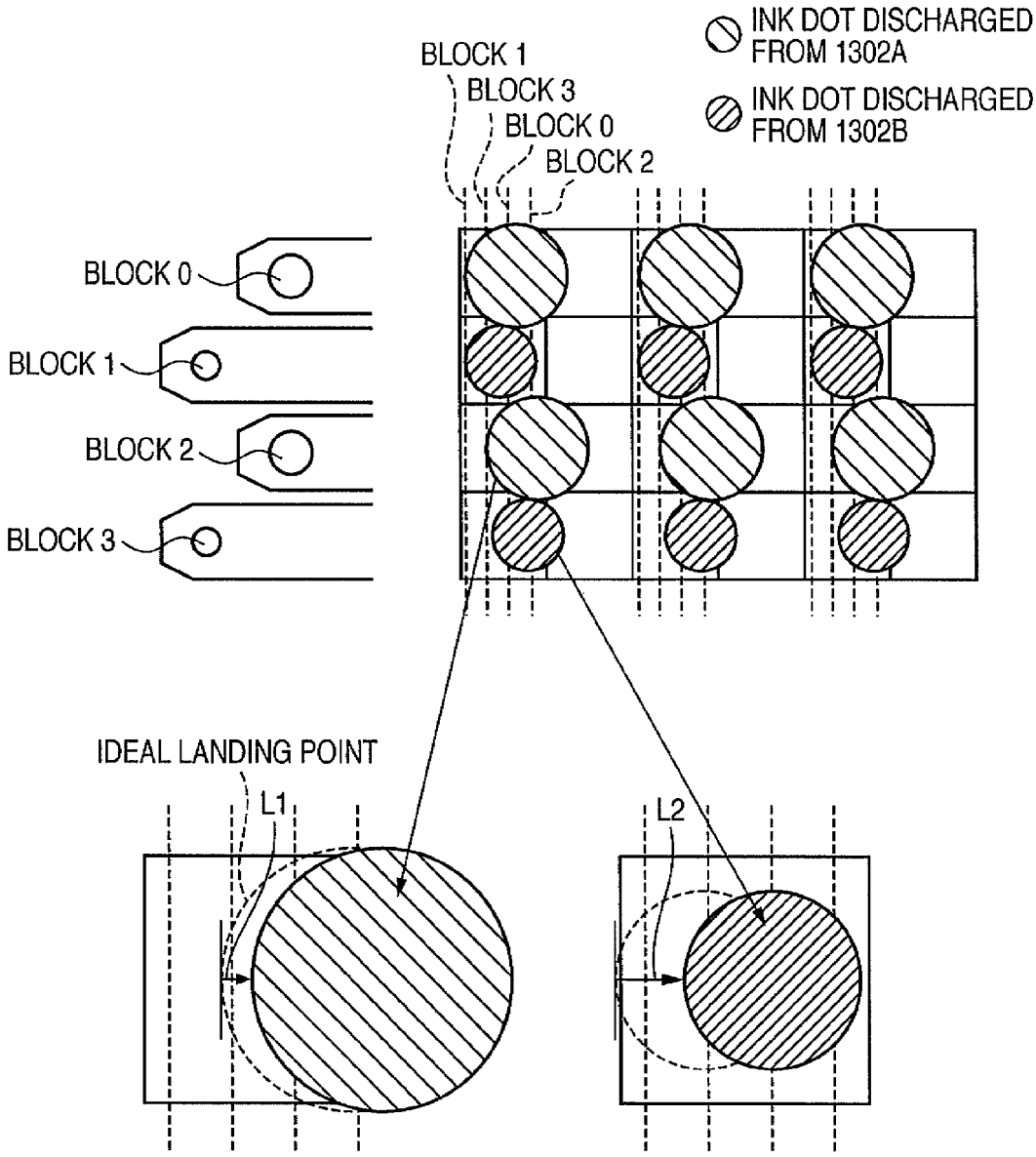
FIG. 15 is another diagram schematically showing how dots of ink discharged from nozzles are formed on a print matrix in the second exemplary embodiment.

As the printhead moves from left to right in FIG. 15, ink droplets discharged from nozzles form ink dots on the print matrix as shown in FIG. 15. As apparent from FIG. 15, the ink dots on the print matrix are placed in desired positions on the print matrix because the driving order is set so that misregistration of landing points caused by the difference between reduction in the discharge speed of the large-diameter nozzle group 1302A and reduction in the discharge speed of the small-diameter nozzle group 1302B is reduced.

While the printing has been described in which the printhead moves from left to right in FIG. 15, all ink dots are placed in desired positions in a print matrix by setting a driving order in the same way described above when the printhead moves from right to left in FIG. 15.

Visual checking of a printed material printed by driving all the nozzle arrays as described above under otherwise the same printing conditions that are shown in the timing chart of FIG. 8 showed that a high-quality image without streaks and unevenness can be obtained.

Third Exemplary Embodiment

A printhead used in a third exemplary embodiment has the same nozzle arrays as in the printhead described above and shown in FIG. 6. The configurations of nozzles and signals are the same. In particular, even-numbered nozzle arrays and odd-numbered nozzle arrays are arranged at pitches (approximately 21.2 μm) corresponding to 1200 dpi and each nozzle group includes 128 nozzles. In total, 512 nozzles are provided.

The printhead in the third exemplary embodiment is divided into eight driving blocks for eight nozzles. Blocks 0 to 7 are driven in a set order to discharge ink droplets. The even-numbered and odd-numbered nozzle arrays are connected to a common driving signal line. Ink is supplied from an ink supply path 106 through each ink channel 105 associated with each nozzle 104.

Printing performed using the printhead will be described below.

When a nozzle array 102 is driven at the same timing in one printing scan, the speed at which ink droplets are discharged from nozzle group 702A is relatively high compared with nozzle group 702B.

Figure 20:
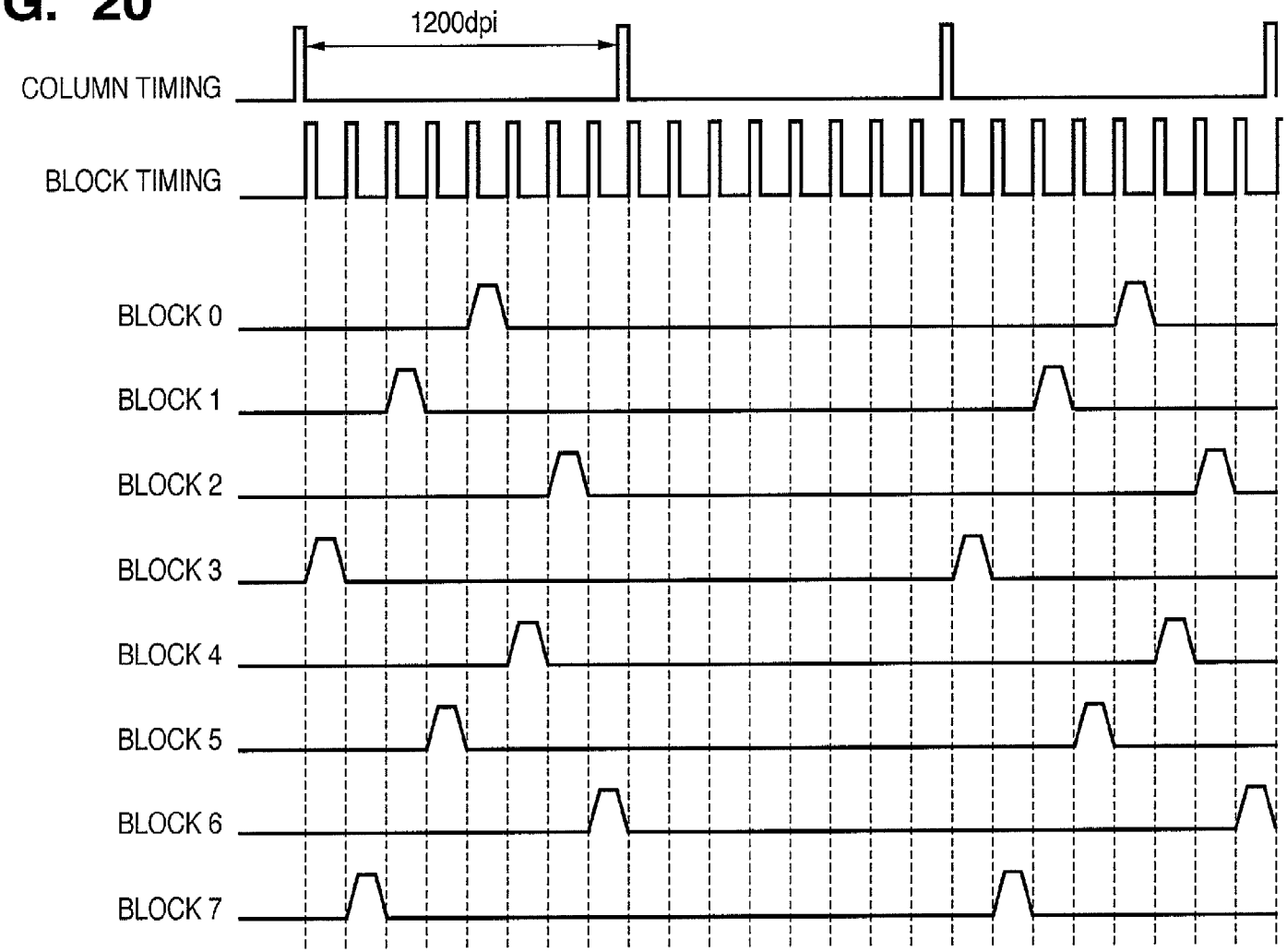
FIG. 20 is a timing chart of driving blocks associated with nozzles of a printhead, showing how the driving blocks are time-divisionally driven in a third exemplary embodiment.

FIG. 20 is a timing chart of an example in which driving blocks associated with the 256 nozzles of nozzle array 102 in the present exemplary embodiment are driven in a time-divisional manner. Here, considering misregistration of landing points caused by a difference between the nozzle group 702A and the nozzle group 702B in discharge speed, the order in which driving blocks are driven is set such that blocks 3, 7, 1, 5, 0, 4, 2, and 6 are driven in this order. Again, misregistration of landing points caused by the arrangement offset (staggered arrangement) between the nozzle groups 702A and 702B in the scanning direction is compensated by shifting driving timing beforehand so that ink droplets land in the same column.

Figure 21:
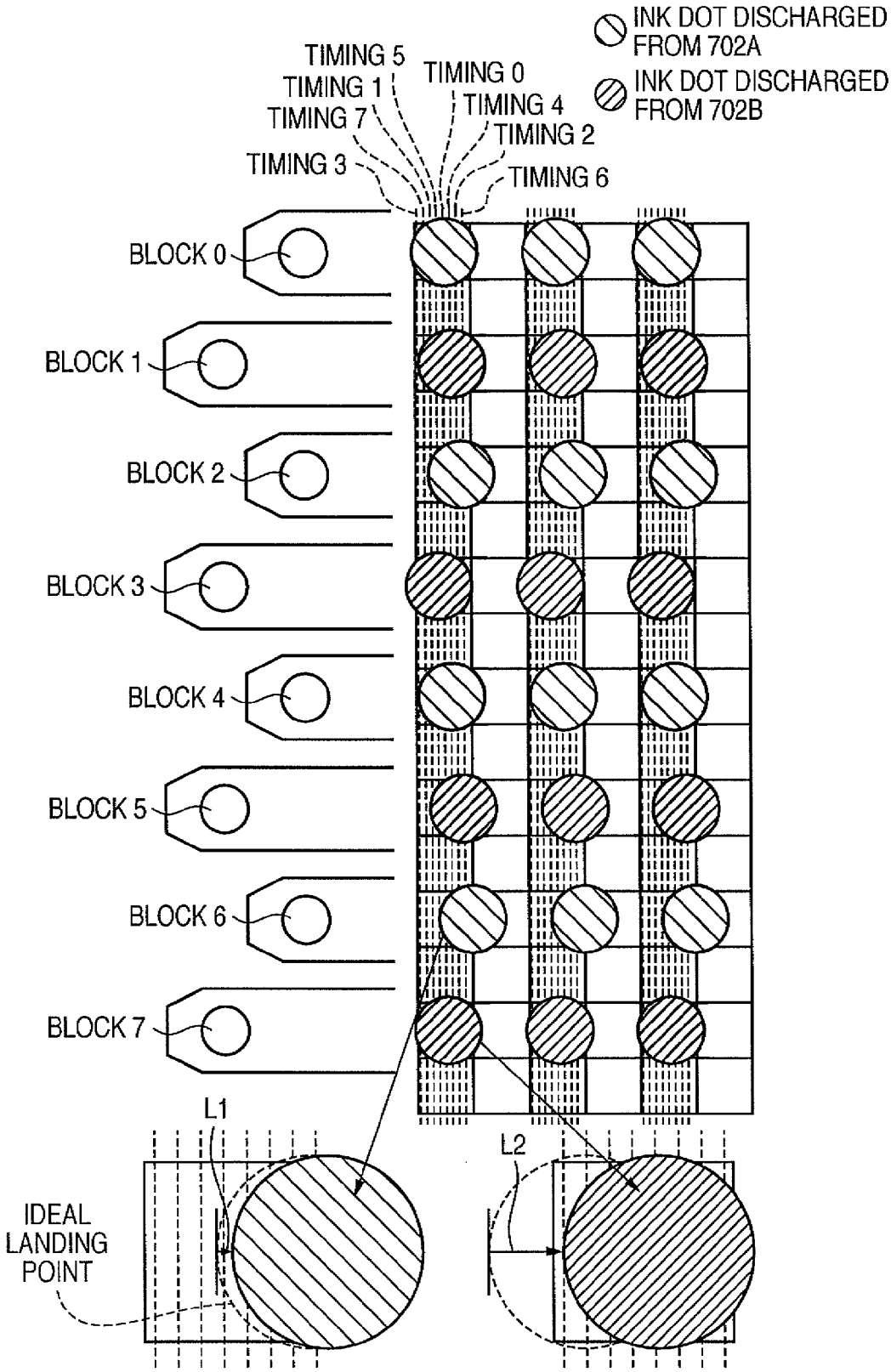
FIG. 21 is a diagram schematically showing how dots of ink discharged from nozzles are formed on a print matrix in the third exemplary embodiment.

As the printhead moves from left to right in FIG. 21, ink dots are formed on a print matrix by ink droplets discharged from nozzles as shown in FIG. 21.

As apparent from FIG. 21, all ink dots on the print matrix are placed in desired positions on the print matrix because the driving order is set so that misregistration of landing points caused by the difference between nozzle groups 702A and 702B in discharge speed is reduced.

Printing was performed using the printhead in which registration of landing points of ink droplets from the odd-numbered nozzle arrays is also adjusted in the same way as described above under the same conditions as in the first exemplary embodiment. Visual checking of a printed material printed by driving as described above showed that a high-quality image can be obtained without streaks and unevenness.

Fourth Exemplary Embodiment

A printhead used in a fourth exemplary embodiment has the same nozzle arrays and the same configuration of nozzles and signals as those shown in FIG. 12 and described above. In particular, nozzles in even-numbered nozzle arrays and odd-numbered discharge arrays are arranged at pitches (approximately 42.5 μm) corresponding to 1200 dpi. Each nozzle group includes 128 nozzles. The number of large-diameter nozzles is 256 and the number of small-diameter nozzles is 256. In total, there are 512 nozzles.

The printhead in the fourth embodiment is divided into eight driving blocks for eight nozzles and blocks 0 to 7 are driven in a set order to discharge ink droplets. The even-numbered and odd-numbered nozzle arrays are connected to a common driving signal line. Ink is supplied from an ink supply path 106 through each ink channel 105 associated with each nozzle 104.

Printing performed by using the head will be described below.

When nozzle array 102 is driven at the same timing in one printing scan, there is a difference in decrease in speed of ink droplets discharged from the large-diameter nozzle group 1302A and the small-diameter nozzle group 1302B before they land. That is, decrease in speed of ink droplets discharged from the small-diameter nozzle group 1302B is greater than that of droplets discharged from the large-diameter nozzle group 1302A.

Figure 22:
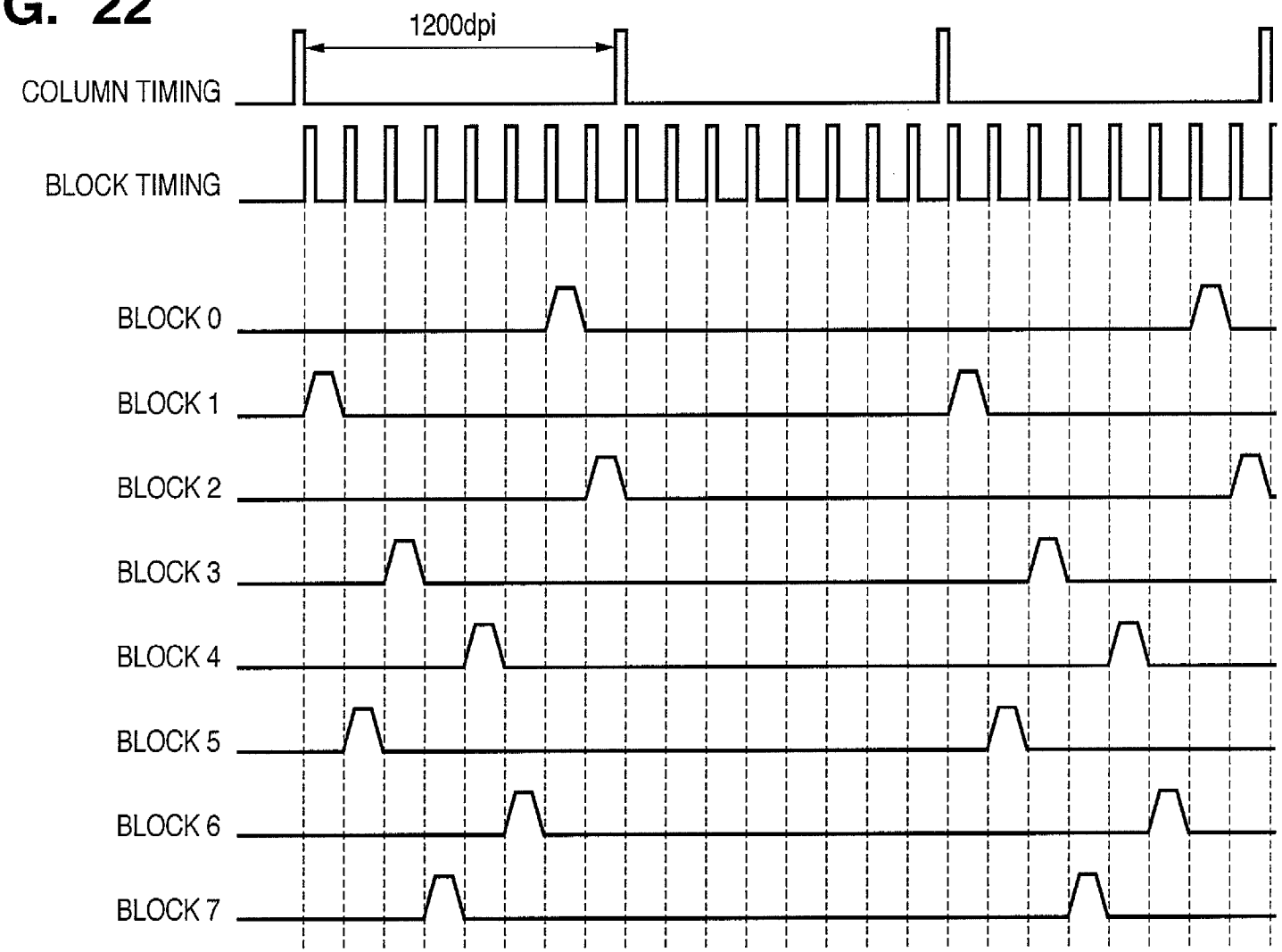
FIG. 22 is a timing chart of driving blocks associated with nozzles of a printhead, showing how the driving blocks are time-divisionally driven in a fourth exemplary embodiment.

FIG. 22 shows a timing chart of an example in which driving blocks associated with 128 large large-diameter nozzles and 128 small-diameter nozzles of nozzle array 102 are driven in a time-divisional manner. There is a difference in displacement of landing points caused by a difference in the reduction in speed of ink droplets discharged from the large-diameter nozzle group 1302A and the small-diameter nozzle group 1302B before they land. Therefore, considering the difference in displacement of landing points, the order in which blocks are driven is set such that blocks 1, 5, 3, 7, 4, 6, 0, and 2 are driven in this order. Again, misregistration of landing points between the nozzle groups 1302A and 1302B caused by the arrangement offset (staggered arrangement) between the nozzle groups 1302A and 1302B in the scanning direction is compensated by shifting driving timing beforehand so that ink droplets land in the same column.

Figure 23:
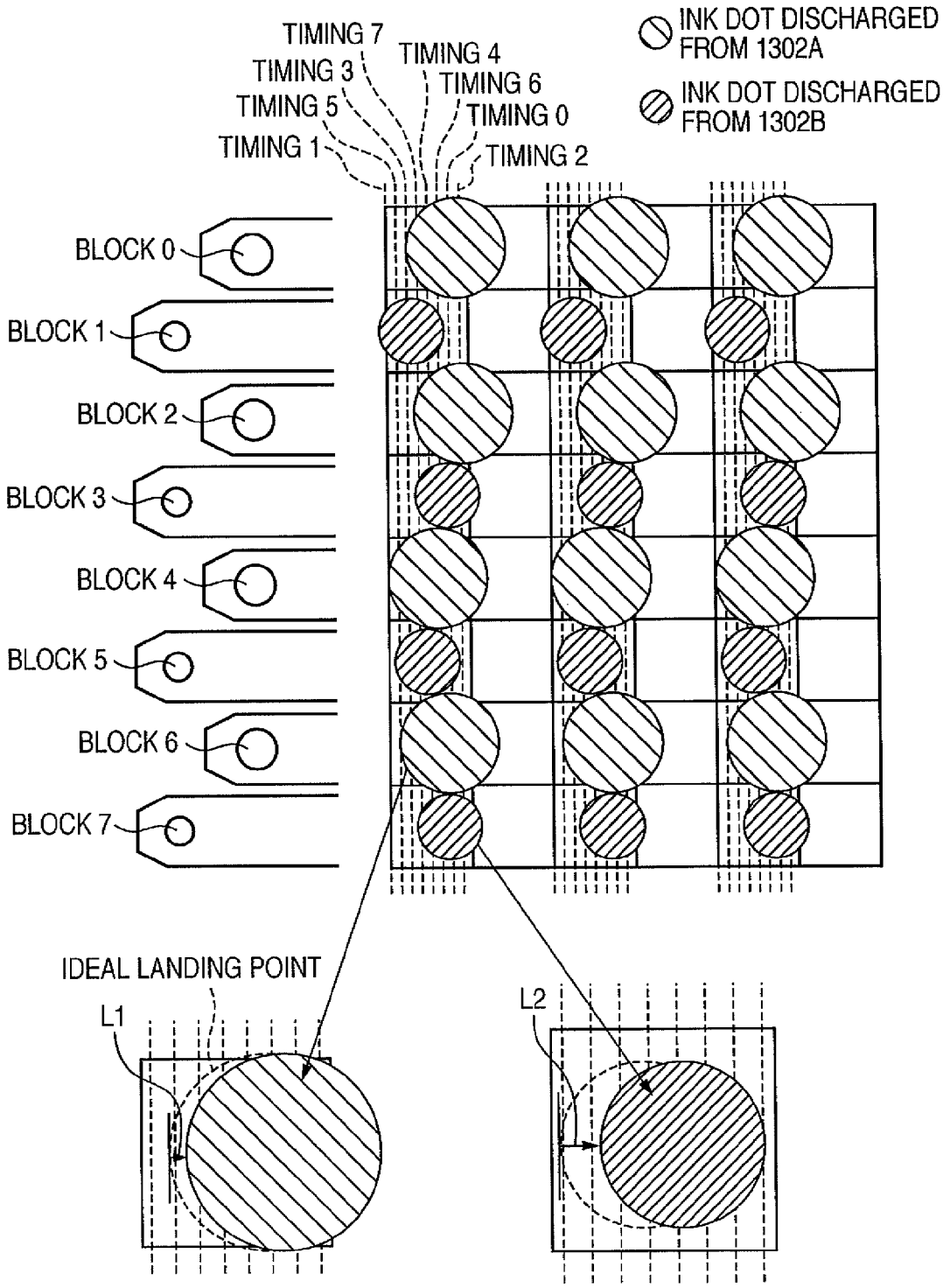
FIG. 23 is a diagram schematically showing how dots of ink discharged from nozzles are formed on a print matrix in the fourth exemplary embodiment.

As the printhead moves from left to right in FIG. 23, ink dots are formed on a print matrix by ink droplets discharged from the nozzles as shown in FIG. 23.

As apparent from FIG. 23, ink dots on the print matrix are placed in desired positions on the print matrix because the driving order is set so that misregistration of landing points caused by the difference in discharge speed reduction between the large-diameter nozzle group 1302A and the small-diameter nozzle group 1302B is reduced.

Printing was performed using the printhead in which registration of landing points of ink droplets discharged from the odd-numbered nozzle arrays is also adjusted in the same way as described above under the same conditions as in the second exemplary embodiment. Visual checking of the printed matter printed by driving as described above showed that a high-quality image can be obtained without streaks and unevenness.

Fifth Exemplary Embodiment

Figure 24:
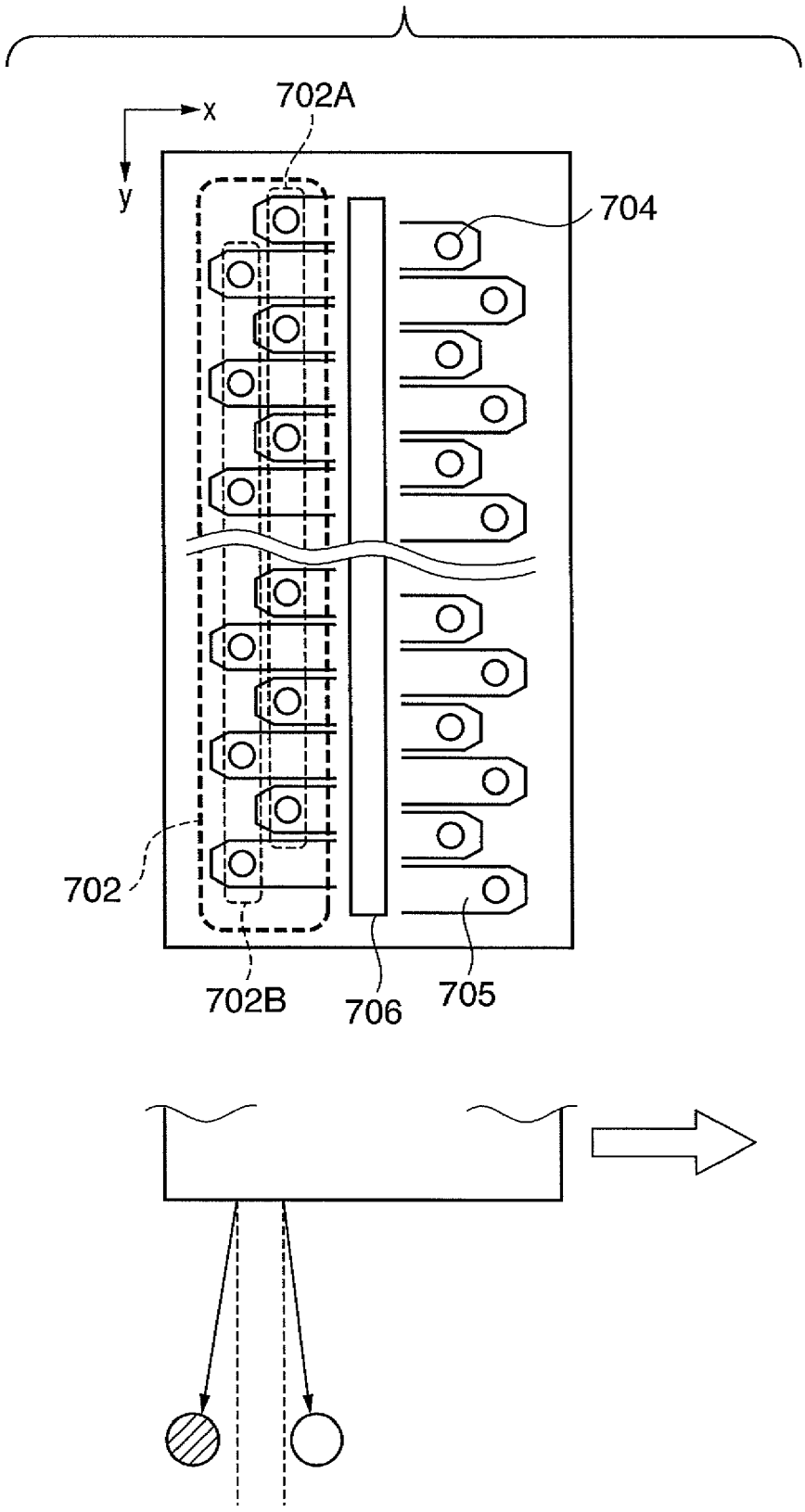
FIG. 24 is a diagram schematically showing an exemplary nozzle array of a printhead of an inkjet printing apparatus and the direction of discharge from the nozzles according to a fifth embodiment.

In a fifth embodiment, a printhead is used that has the same configuration as that in the first exemplary embodiment but different discharge characteristics. The printhead is shown in FIG. 24. The printhead has the same nozzle arrays as those in the printhead shown in FIG. 6 and described above and the configuration of each nozzle is also the same. In particular, nozzles, both in an even-numbered nozzle array and an odd-numbered nozzle array, are arranged at pitches (approximately 21.2 μm) corresponding to 1200 dpi. Each nozzle array has 256 nozzles. In total, there are 512 nozzles. The printhead used in the present exemplary embodiment differs from the printhead used in the first exemplary embodiment in that ink droplets discharged from a nozzle group 702A in the printhead in the fifth exemplary embodiment are deflected toward the ink supply path 106 side and ink droplets discharged from a nozzle group 702B are deflected to the opposite side of the ink supply path 106.

The printhead in the fifth exemplary embodiment is divided into eight driving blocks for eight nozzles. Blocks 0 to 7 are driven in a set order to discharge ink droplets. The even-numbered nozzle array and odd-numbered nozzle array are driven using a common driving signal line. Ink is supplied from an ink supply path 106 to each nozzle 104 through an ink channel 105 associated with the each nozzle 104.

Printing by using the printhead will be described below.

When a nozzle array 102 is driven at the same timing in one printing scan, ink droplets are discharged from the nozzle groups 702A and 702B in significantly different directions as shown in FIG. 24. For example, when the printhead moves from left to right in one scan as indicated by the arrow in FIG. 24, ink-droplets discharged from the nozzle group 702A tend to be inclined toward the upstream side (right-hand side of FIG. 24) with respect to a vertical downward direction from the nozzles. Ink droplets discharged from the nozzle group 702B tend to be inclined toward the downstream side (left-hand side of FIG. 24). Ink droplets discharged from the nozzle group 702A has greater kinetic energy than ink droplets discharged from the nozzle group 702B. This is because movement of the printhead increases the discharge speed of ink droplets discharged from the nozzle group 702A and decreases the discharge speed of ink droplets discharged from the nozzle group 702B.

When the printhead is moved in the scan direction indicated by the arrow in FIG. 24 to print, displacements between landing points of ink droplets discharged from the nozzle group 702B will be greater than those of ink droplets discharged from the nozzle group 702A.

FIG. 20 shows a timing chart of an example in which driving blocks associated with 256 nozzles of nozzle array 102 are driven in a time-divisional manner. Again, misregistration of landing points caused by the arrangement offset (staggered arrangement) of the nozzle groups 702A and 702B in the scan direction and the difference in discharge direction is compensated by shifting driving timing beforehand so that ink droplets land in the same column.

Considering misregistration of landing points caused by differences in discharge direction between the nozzle group 702A and the nozzle group 702B, the order in which the blocks are driven is set such that blocks 3, 7, 1, 5, 0, 4, 2, and 6 are driven in this order.

As the printhead moves from left to right as indicated by the arrow in FIG. 24, ink droplets are discharged from the nozzles and ink dots are formed on a print matrix as shown in FIG. 21.

As can be seen from FIG. 21, the ink dots are placed in desired position on the print matrix because the driving order is set so that misregistrations of landing points caused by the differences between nozzle groups 702A and 702B in discharge speed are reduced.

A printhead in which registrations of landing points of the odd-numbered nozzle array were also adjusted in the same way as described above was used to perform printing. Visual checking of a pint material printed by the driving described above showed that a high-quality image without streaks and unevenness can be obtained.

Figure 16:
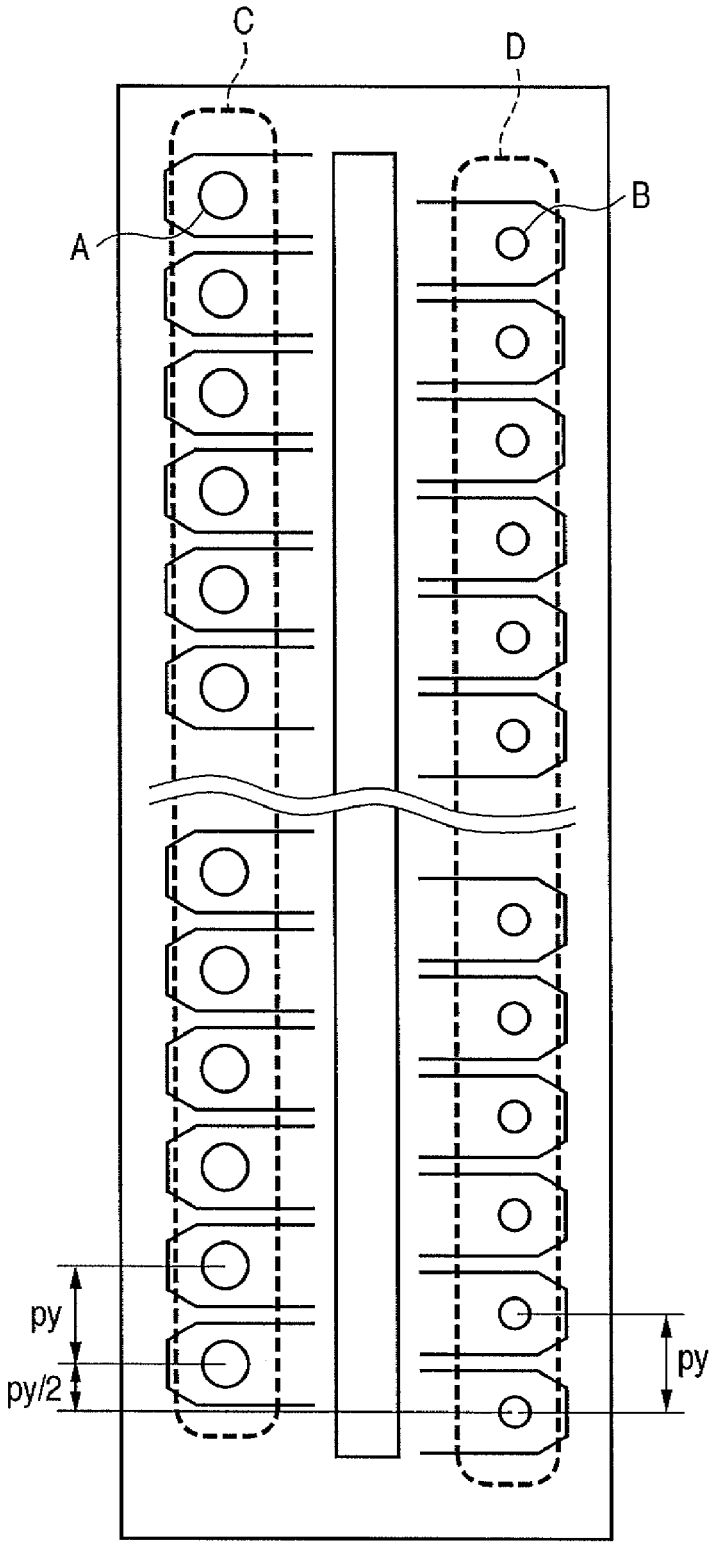
FIG. 16 shows a variation of configuration of nozzles of a printhead used in a printing apparatus according to the present invention.
Figure 17:
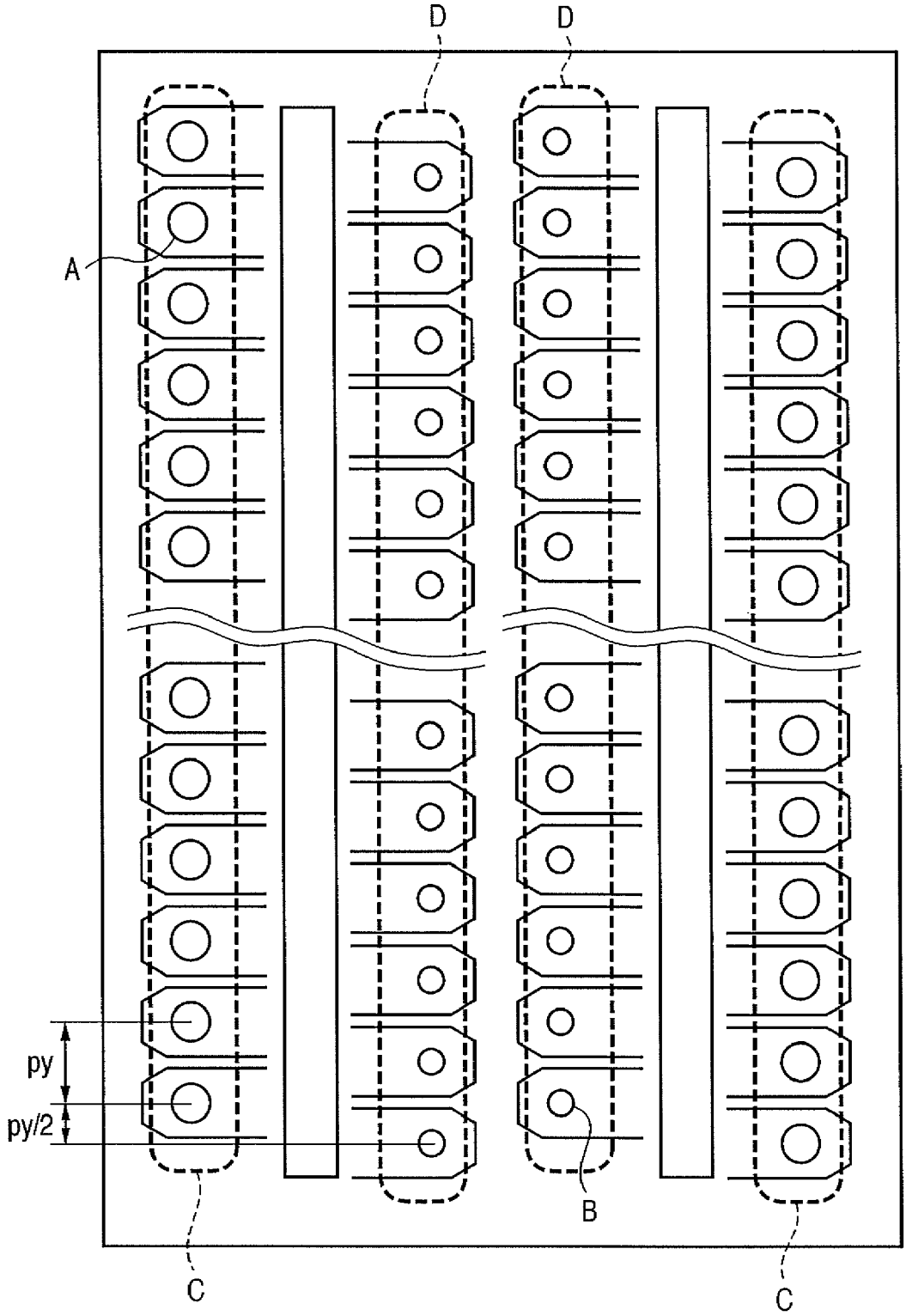
FIG. 17 shows another variation of configuration of nozzles of a printhead used in a printing apparatus according to the present invention.

Printhead configurations other than those described in the first to fifth exemplary embodiments can be used as well, provided that they can be implemented in a relatively simple manner at low costs. For example, FIGS. 16 to 19 show various exemplary configurations of nozzle groups of a printhead used in a printing apparatus of the present invention. In these configurations, nozzle group A discharges a larger amount of ink than nozzle group B. FIG. 16 shows a configuration in which nozzle group A and nozzle group B are formed by different nozzle arrays C and D respectively, and the two arrays are offset from each other by a half of the nozzle pitch. FIG. 17 shows a configuration in which two pairs of nozzle arrays C and D are provided, the two arrays of nozzle group A are offset from each other by a half of the nozzle pitch, and the two arrays of nozzle group B are offset from each other by a half of the nozzle pitch.

Figure 18:
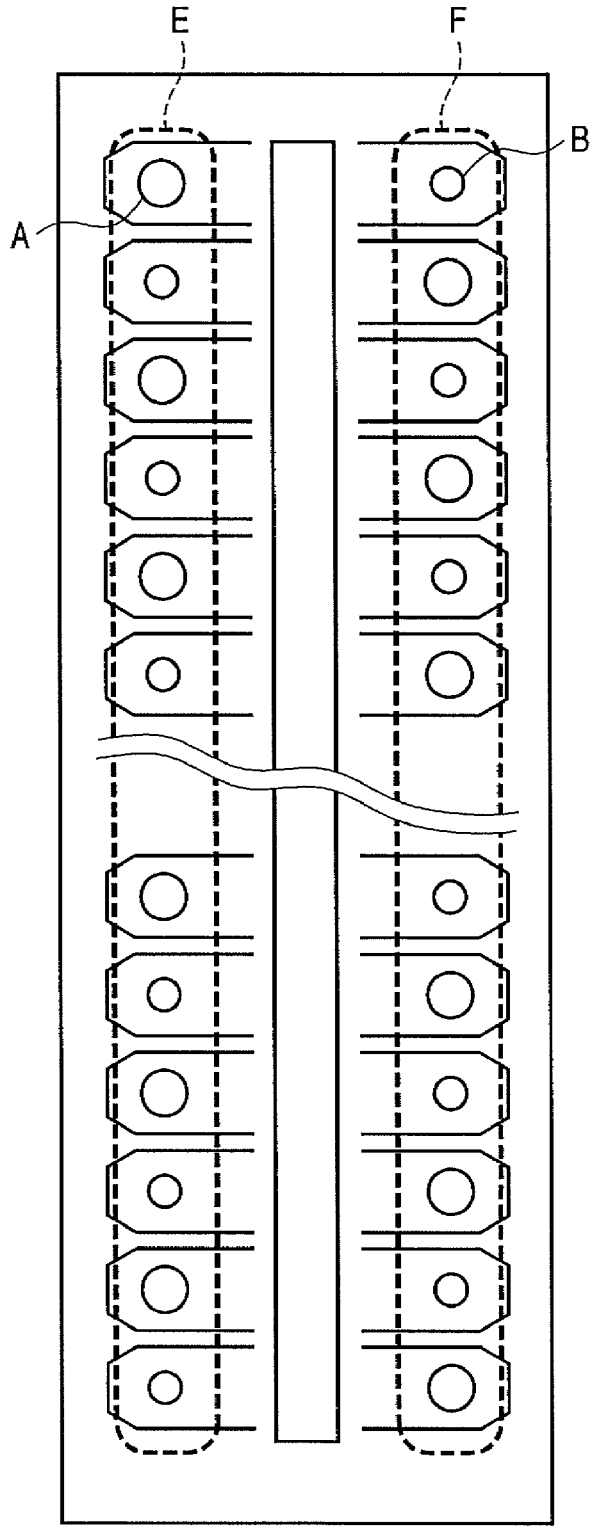
FIG. 18 shows yet another variation of configuration of nozzles of a printhead used in a printing apparatus according to the present invention.
Figure 19:
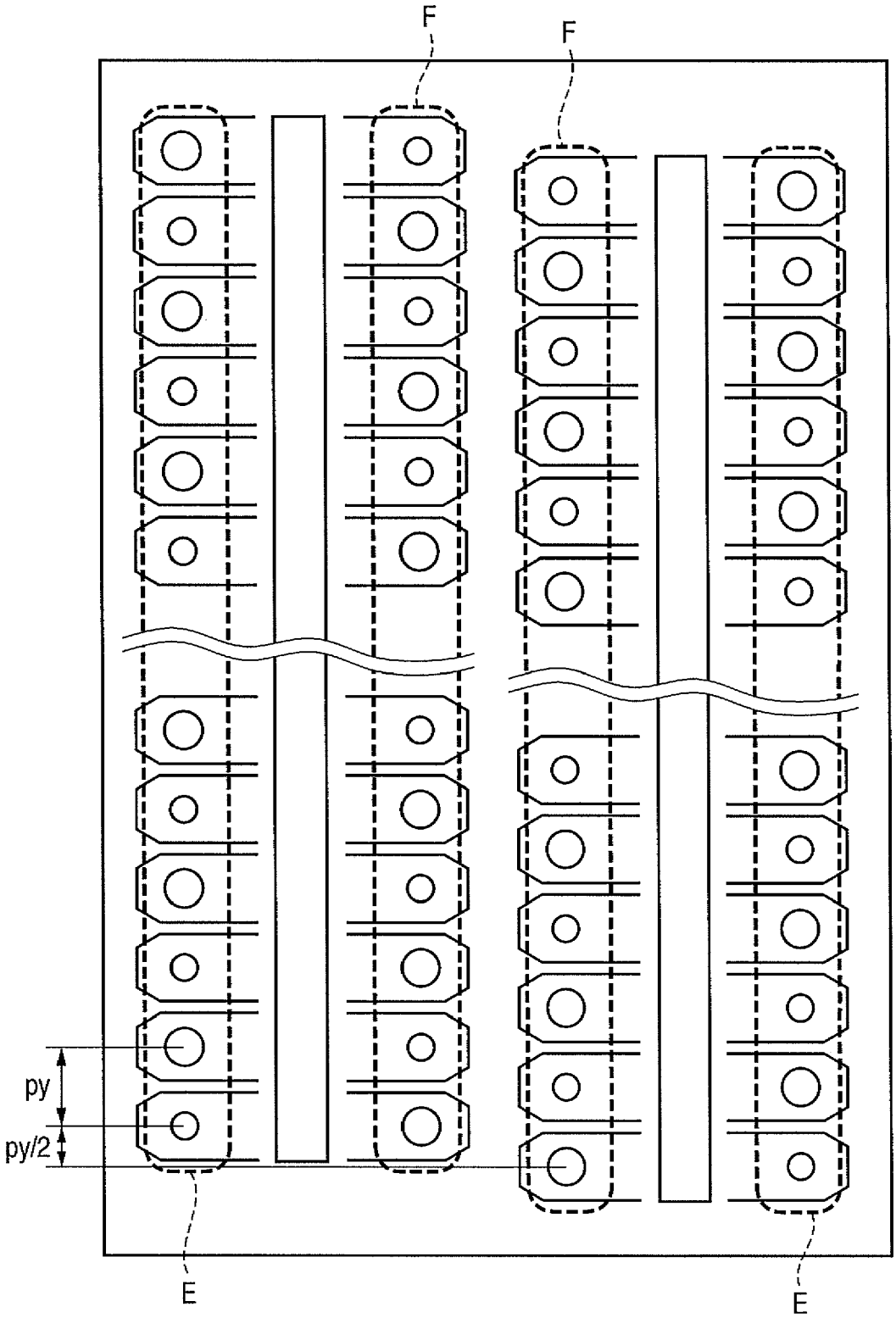
FIG. 19 shows yet another variation of configuration of nozzles of a printhead used in a printing apparatus according to the present invention.

FIGS. 18 and 19 show configurations in which nozzle groups A and B are provided in the same nozzle array (nozzle array E or F). In the configuration in FIG. 18, one nozzle array E and another nozzle array F are provided and the nozzles in nozzle group A are arranged differently from those in nozzle group B. In the configuration in FIG. 19, two pairs of nozzle arrays E and F are provided and the pairs of nozzle arrays E and F are offset from each other by a half of the nozzle pitch.

Figure 25:
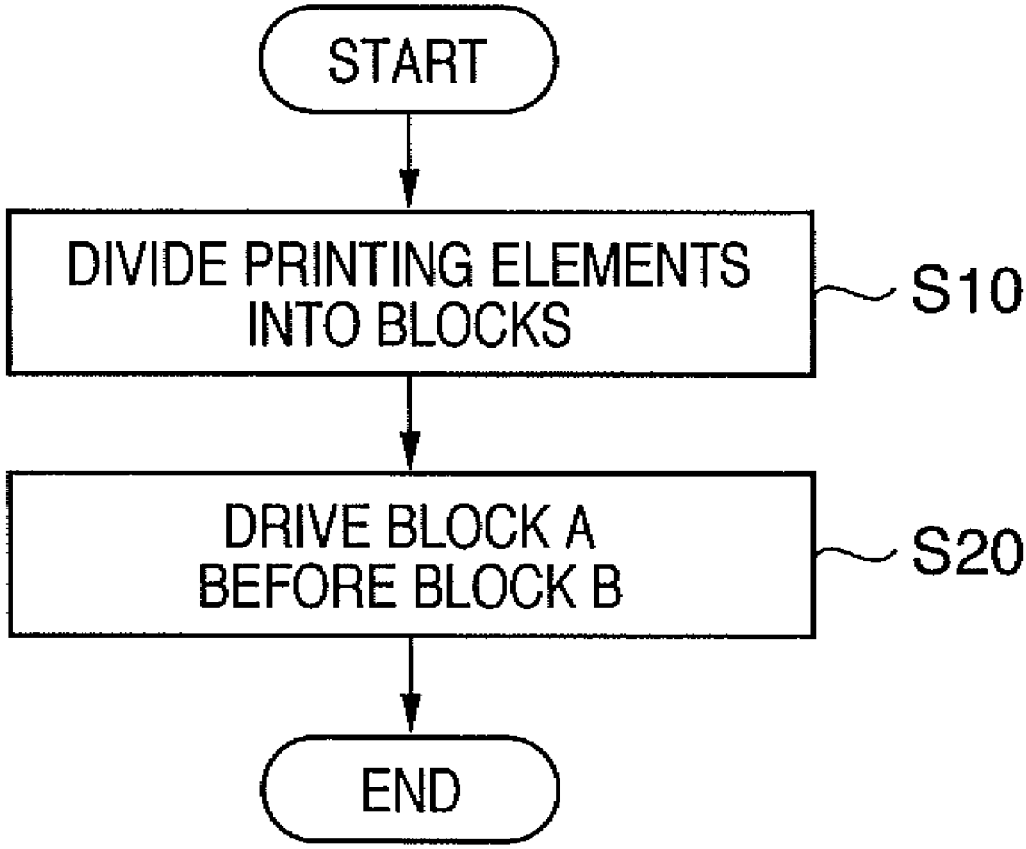
FIG. 25 is a flowchart illustrating a method for adjusting registration of landing points of droplets according to the present invention.

The printing method according to the present embodiments will be described with reference to the flowchart of FIG. 25.

First, at step S10, the printing elements are divided into two different blocks, one (block A) consisting of multiple first printing elements that provide first discharge energy to ink to be discharged and the other (block B) consisting of multiple second printing elements that provide second discharge energy greater than the first discharge energy to ink to be discharged. Then, block A is driven to print before block B at S20.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-333864, filed Dec. 11, 2006, which is hereby incorporated by reference herein in its entirety.

What is claimed is:

1. An inkjet printing apparatus which performs printing by discharging ink droplets having different sizes to a printing medium by using a printhead having a plurality of first printing elements which generate energy for discharging ink droplets and a plurality of second printing elements which generate energy for discharging ink droplets larger than those from said plurality of first printing elements, wherein said inkjet printing apparatus comprises:

a time-divisional driving unit which divides said plurality of first printing elements and said plurality of second printing elements into multiple blocks so that said plurality of first printing elements belong to a block different from a block to which said plurality of second printing elements belong and drives the blocks individually in a time-divisional manner;

a control unit which controls said time-divisional driving unit to drive the block consisting of said plurality of first printing elements first and then drive the block consisting of said plurality of second printing elements; and a scanning unit which causes said printhead to scan forward and backward, wherein, when said printhead moves in a forward scanning direction, said control unit controls said time-divisional driving unit to drive a block consisting of printing elements located on the downstream side in the forward scanning direction as the block consisting of said first printing elements before driving the block consisting of said second printing elements, and when said printhead moves in a backward scanning direction, said control unit controls said time- divisional driving unit to drive a block consisting of printing elements located on the downstream side in the backward scanning direction as the block consisting of said first printing elements before driving the block consisting of said second printing elements.

2. The inkjet printing apparatus according to claim 1, wherein said printhead comprises an ink supply path for supplying ink to each of said printing elements and ink channels for supplying ink to each of said printing elements from said ink supply path; and said ink channels for supplying ink to said plurality of first printing elements are longer than said ink channels for supplying ink to said plurality of second printing elements.

3. The inkjet printing apparatus according to claim 1, wherein said printhead includes nozzles associated with said printing elements; and a size of nozzles associated with said plurality of first printing elements is smaller than a size of nozzles associated with said plurality of second printing elements.

4. The inkjet printing apparatus according to claim 1, wherein said printhead comprises one print element array in which said first printing elements and said second printing elements are arranged.

5. A driving control method in an inkjet printing apparatus which performs printing by discharging ink droplets having different sizes to a printing medium by using a printhead having a plurality of first printing elements which generate energy for discharging ink droplets and a plurality of second printing elements which generate energy for discharging ink droplets larger than those from the plurality of first printing elements, wherein the inkjet printing apparatus comprises a scanning unit which causes the printhead to scan forward and backward, wherein the plurality of first printing elements and the plurality of second printing elements are divided into multiple blocks so that the plurality of first printing elements belong to a block different from a block to which the plurality of second printing elements belong, the divided blocks are individually driven in a time-divisional manner, driving of the printhead is controlled so that the plurality of first printing elements are driven first and then the plurality of second printing elements are driven, and when the printhead is moved in a forward scanning direction by the scanning unit, a block consisting of printing elements located on the downstream side is driven in the forward scanning direction as the block consisting of the first printing elements before the block consisting of the second printing elements is driven, and when the printhead is moved in a backward scanning direction by the scanning unit, a block consisting of printing elements located on the downstream side is driven in the backward scanning direction as the block consisting of the first printing elements before the block consisting of the second printing elements is driven.

6. An inkjet printing apparatus comprising:

a printhead having a first nozzle group consisting of a plurality of nozzles and a second nozzle group consisting of a plurality of nozzles which are larger than the nozzles of the first nozzle group;

a scanning unit which causes said printhead to scan in a direction crossing a direction in which the nozzles of the first nozzle group are arranged;

a time-divisional driving unit which divides the nozzles of the first nozzle group and the nozzles of the second nozzle group into multiple blocks so that the nozzles of the first nozzle group belong to a block different from a block to which the nozzles of the second nozzle group belong and drives the divided blocks in a time-divisional manner; and a control unit which, when the scanning unit causes the printhead to scan in a direction in which the second nozzle group is positioned ahead of the first nozzle group, controls the time-divisional driving unit to drive a block to which the nozzles of the first nozzle group belong before driving a block to which the nozzles of the second nozzle group belong.

7. The inkjet printing apparatus according to claim 6, wherein, when said scanning unit causes the printhead to scan in a direction in which the first nozzle group is positioned ahead of the second nozzle group, said control unit controls said time-divisional driving unit to drive a block to which the nozzles of the second nozzle group belong before driving a block to which the nozzles of the first nozzle group belong.

8. The inkjet printing apparatus according to claim 6, wherein said printhead comprises an ink supply path for supplying ink to each of the nozzles and ink channels for supplying ink to each of the nozzles from the ink supply path, and the ink channel for supplying ink to the nozzles of the first nozzle group are longer than the ink channels for supplying ink to the nozzles of the second nozzle group.

* * * * *